US012203331B2

(12) United States Patent
Rasmussen et al.

(10) Patent No.: US 12,203,331 B2
(45) Date of Patent: Jan. 21, 2025

(54) ELECTRICAL CONNECTION ASSEMBLY FOR DOWNHOLE WIRELINE

(71) Applicants: Jon Randall Rasmussen, Williston, ND (US); Brandon J. Fair, Queen Creek, AZ (US)

(72) Inventors: Jon Randall Rasmussen, Williston, ND (US); Brandon J. Fair, Queen Creek, AZ (US)

( * ) Notice: Subject to any disclaimer, the term of this patent is extended or adjusted under 35 U.S.C. 154(b) by 67 days.

(21) Appl. No.: 17/821,148

(22) Filed: Aug. 19, 2022

(65) Prior Publication Data

US 2023/0101912 A1 Mar. 30, 2023

Related U.S. Application Data

(63) Continuation-in-part of application No. 17/846,932, filed on Jun. 22, 2022.

(60) Provisional application No. 63/249,771, filed on Sep. 29, 2021, provisional application No. 63/249,890, filed on Sep. 29, 2021.

(51) Int. Cl.
*E21B 29/04* (2006.01)

(52) U.S. Cl.
CPC ..... *E21B 29/04* (2013.01)

(58) Field of Classification Search
CPC ..... E21B 29/04
See application file for complete search history.

(56) References Cited

U.S. PATENT DOCUMENTS 4,736,797 A * 4/1988 Restarick, Jr. ..... E21B 17/003 166/301
4,738,312 A * 4/1988 Wittrisch ..... E21B 17/025 166/54.5

(Continued)

FOREIGN PATENT DOCUMENTS

JP 2013141490 A 7/2013

OTHER PUBLICATIONS

WIPO Machine Translation of Publication No. JP 2013141490—IV Stand Traveling Device; Published Jul. 22, 2013; Parent of U.S. Pat. No. 8,944,836 B2; Issued: Feb. 3, 2015; Includes translated copy of original filed figures; 17 pages.

(Continued)

*Primary Examiner* — Kipp C Wallace
(74) *Attorney, Agent, or Firm* — Peter L. Brewer; Thrive IP

(57) ABSTRACT

An electrical connection assembly for a wireline cutting tool. The electrical connection assembly comprises an electrical connection sub having an upstream end and a downstream end. A pin connector resides within a bore of the electrical connection sub, with the pin connector having a conductive pin. The electrical connection assembly also includes a signal line connector. The signal line connector extends from an upstream end of the electrical connection sub and is in electrical communication with an electric wireline within a wellbore. The signal line connector places the electric wireline in electrical communication with a signal line further downhole. The signal line is associated with a downhole tool. A downstream end of the conductive pin is connected to the signal line. The electrical connection assembly also includes a spring that is wound around the pin and which biases the conductive pin out of a bore of the downstream end of the electrical connection sub.

25 Claims, 24 Drawing Sheets

(56) References Cited

U.S. PATENT DOCUMENTS

| | | | | |
|---|---|---|---|---|
| 4,886,115 | A * | 12/1989 | Leggett | E21B 33/072 166/217 |
| 4,909,321 | A | 3/1990 | Petree | |
| 4,997,041 | A | 3/1991 | Petree | |
| 6,032,733 | A | 3/2000 | Ludwig et al. | |
| 6,431,269 | B1 | 8/2002 | Post et al. | |
| 6,591,912 | B2 | 7/2003 | Ross et al. | |
| 6,880,637 | B2 | 4/2005 | Myers, Jr. et al. | |
| 7,114,563 | B2 | 10/2006 | Rose | |
| 7,264,060 | B2 | 9/2007 | Wills | |
| 7,343,979 | B2 | 3/2008 | Dreggevik | |
| 7,409,987 | B2 | 8/2008 | Fjelde | |
| 7,857,066 | B2 | 12/2010 | DiFoggio et al. | |
| 8,264,814 | B2 | 9/2012 | Love et al. | |
| 8,424,595 | B2 | 4/2013 | Sach | |
| 8,505,633 | B2 | 8/2013 | McKee | |
| 8,944,836 | B2 | 2/2015 | Mori et al. | |
| 9,068,411 | B2 | 6/2015 | O'Connor et al. | |
| 9,476,276 | B2 * | 10/2016 | Wells | E21B 29/04 |
| 9,587,465 | B2 * | 3/2017 | Smith | E21B 47/09 |
| 9,822,596 | B2 | 11/2017 | Clemens et al. | |
| 10,844,698 | B2 | 11/2020 | Kanstad et al. | |
| 10,947,812 | B2 | 3/2021 | George et al. | |
| 10,975,650 | B2 | 4/2021 | Holodnak et al. | |
| 11,002,100 | B2 | 5/2021 | Johnsen et al. | |
| 11,021,923 | B2 * | 6/2021 | Mulhern | E21B 23/0414 |
| 11,078,739 | B2 | 8/2021 | Davies et al. | |
| 11,078,762 | B2 | 8/2021 | Mauldin et al. | |
| 11,193,336 | B2 | 12/2021 | Ash et al. | |
| 11,255,147 | B2 | 2/2022 | Eitschberger et al. | |
| 11,268,376 | B1 | 3/2022 | Jackson et al. | |
| 11,307,011 | B2 | 4/2022 | Eitschberger et al. | |
| 11,339,632 | B2 | 5/2022 | Eitschberger et al. | |
| 11,359,898 | B2 | 6/2022 | Perry et al. | |
| 11,385,036 | B2 | 7/2022 | Preiss et al. | |
| 2022/0145716 | A1 * | 5/2022 | Kleinschmit | E21B 17/026 |

OTHER PUBLICATIONS

Letter from Attorney Thomas Kalil to Mechanical Revolution, LLC dated Jun. 15, 2021, 2 pages.

Enclosure 1 of 3 of letter from Attorney Thomas Kalil to Mechanical Revolution, LLC dated Jun. 15, 2021, 1 page.

Enclosure 2 of 3 of letter from Attorney Thomas Kalil to Mechanical Revolution, LLC dated Jun. 15, 2021, 1 page.

Enclosure 3 of 3 of letter from Attorney Thomas Kalil to Mechanical Revolution, LLC dated Jun. 15, 2021, 1 page.

"Order Denying Plaintiff's Claims of Patent Infringement, Breach of Contract, and Unjust Enrichment, and Granting Defendant's Request for Declaratory Judgment" from North Dakota District Court; Civil Case No. 53-2021-CV-01197; Issued Jul. 21, 2023; 20 pages.

* cited by examiner

ELECTRICAL CONNECTION ASSEMBLY FOR DOWNHOLE WIRELINE

STATEMENT OF RELATED APPLICATIONS

This application claims the benefit of U.S. Ser. No. 63/249,890 entitled "Electrical Connection Assembly for Downhole Wireline." That application was filed on Sep. 29, 2021.

This application is also filed as a Continuation-in-Part of U.S. Ser. No. 17/846,932 filed Jun. 22, 2022. That application is entitled "Mechanical Release Tool for Downhole Wireline."

U.S. Ser. No. 17/846,932 claimed the benefit of U.S. Ser. No. 63/249,771 filed Sep. 29, 2021. That application is also entitled "Mechanical Release Tool for Downhole Wireline."

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light and not necessarily as admissions of prior art.

Field of the Invention

The present disclosure relates to the field of hydrocarbon recovery operations. More specifically, the present invention relates to a wireline cutting tool used for releasing a downhole tool by severing the wireline within a wellbore. A novel electrical connection assembly that releases the wireline from a downhole signal line is also provided.

Discussion of Technology

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular region is thus formed between the string of casing and the formation penetrated by the wellbore.

A cementing operation is conducted in order to fill or "squeeze" the annular region with cement along part or all of the length of the wellbore. The combination of cement and casing strengthens the wellbore and facilitates the zonal isolation of aquitards and hydrocarbon-producing zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include production casing.

During the completion of the well, it is common to run certain tools into the well at the end of a long wireline. In the case of wells that are completed horizontally, the tools will be pumped into the wellbore at the end of the wireline. Such tools may include perforating guns, casing collar locators, plugs and well-logging equipment.

The wireline is typically an electric line. The electric line will include an inner conductive wire, which may be a collection of copper or other conductive wires. In one aspect, the inner copper wire represents two insulated wires and a ground wire. The insulated wires may be solid wires or strands that have been braided or otherwise wrapped together.

The electric line will also include an armor layer that resides around the conductive wire core. The armor layer may include a plurality of metal wires which may or may not be stranded or braded. Alternatively, a carbon fiber layer is used as the armor layer. Those of ordinary skill in the art will understand that a variety of armors are known.

The electric line will also have an outer insulating layer. The outer insulating layer is typically fabricated from a polycarbonate material, designed to withstand the high pressures and high temperatures of the wellbore. The polycarbonate material is also resistant to corrosion from hydrocarbon fluids and wellbore chemicals residing downhole.

The electric wireline will have a defined tensile strength. The tensile strength must be higher than any anticipated tension that may be applied to the line from the surface during pumping and unspooling. In addition, the wireline is designed to have a point of weakness. The point of weakness resides just above the downhole tool, typically at a connection sub. The point of weakness allows an operator to pull the wireline out of the hole in the event the connected downhole tool becomes stuck. This typically occurs when the downhole tool is being pulled through a so-called "dogleg" of the wellbore. The dogleg is a location at which a direction of the wellbore changes sharply, commonly found at a point of inflection between the near-vertical wellbore and the horizontal "leg" of the wellbore.

Severing the wireline at the point of weakness allows the operator to spool the electric line back out of the hole and then run a fishing tool into the wellbore. The fishing tool may be run into the hole at the end of coiled tubing or other line having a substantially higher tensile strength than the electric line. The fishing tool is designed to catch the wireline tool at the connection sub so that the tool may be removed from the wellbore. If the "fishing expedition" is not successful, the downhole tools are lost. More significantly, the well itself may be lost and will need to be re-drilled.

A problem arises in connection with fishing the downhole tool, that being the frayed electric line can interfere with the operator's attempts to grab on to the head, or fishing neck, of the connection sub. Those of ordinary skill in the art will understand that the frayed electric line will expose many wires, fragments, and loose ends. For this reason, a need exists for a way of severing the wireline in a clean and efficient manner without relying upon a point of weakness.

In lieu of a point of weakness, some wireline release mechanisms employ a so-called ballistic release tool. The ballistic release tool resides along the wireline below the casing collar locator (or "CCL") and below the weight bars (sometimes referred to as sinker bars). If a perforating gun assembly becomes stuck, the operator can activate the ballistic release tool and bring out the CCL, the weight bars, and the wireline out of the wellbore and back to surface. However, if the tool string is stuck above the ballistic release tool, or even on the weight bars, it does the operator no good to set off the ballistic release tool as that portion of the tool string below the ballistic release tool will disconnect and the tool string remains stuck in the wellbore.

It is also observed that the ballistic release tool utilizes an explosive charge that severs the wireline in a violent and sometimes unpredictable manner. Ancillary damage can be done to the tools, or even the wellbore, while at the same time the wireline itself may not always separate.

Therefore, a need again exists for a method of severing an electric line from a downhole tool in a clean, predictable manner just above the casing collar locator or other downhole tools. A need also exists for an electrical connection assembly that places the wireline in electrical communication with downhole signal lines, that works with a wireline cutting tool.

SUMMARY OF THE INVENTION

A wireline cutting tool is first provided herein. The wireline cutting tool is designed to be run into a wellbore on a wireline with a downhole tool. Examples of a downhole tool include a casing collar locator (CCL) and a perforating gun assembly. The wireline cutting tool is used to sever the wireline in the event that the downhole tool becomes stuck during pull-out. Preferably, the wellbore wireline is an electric wireline.

The wireline cutting tool comprises an upper tubular sub and a lower tubular sub. Each of the subs has a first end, and a second end opposite the first end, with a bore extending from the second end and through the first end. The first end of the lower sub is threadedly connected to the second end of the upper sub. Preferably, the second end of the upper sub comprises female threads, while the first end of the lower sub comprises male threads.

The wireline cutting tool also includes a knife housing. The knife housing resides within the bore of the upper sub. The knife housing has a first end, a second end opposite the first end, and a bore extending from the second end up to and through the first end. Of interest, the bore of the knife housing tapers inwardly moving in a direction from the second end of the upper sub up toward the first end of the upper sub.

The wireline cutting tool additionally comprises a plunger. The plunger defines a generally tubular body that resides within the bore of the lower sub. The plunger has a first end and a second end opposite the first end. The plunger is configured to slide up the bore of the lower sub in response to a first shear load applied by a wellbore wireline.

The wireline cutting tool also includes at least one knife. Preferably, two knives are provided, with the knives residing on opposing sides of the bore of the knife housing. The knives are configured to slide up the bore of the knife housing from the second end towards the first end in response to a second shear load. The second shear load is greater than the first shear load.

In operation, the sliding up of the plunger causes the first end of the plunger to engage a lower end of each of the knives. In turn, the sliding up of the knives causes the wellbore wireline to be pinched and ultimately severed.

The wireline cutting tool is designed so that the first shear load is applied by the wireline being spooled from a surface. Thereafter, the second shear load is applied by the plunger acting against the knives from below. At the same time, the force applied by the plunger is also caused by the spooling of the wireline from the surface at the second shear load.

The wireline cutting tool further comprises an electrical connection assembly. The electrical connection assembly includes a tubular body, referred to as an electrical connection sub. The electrical connection sub houses an elongated conductive pin. The electrical connection sub includes a shoulder along an outer diameter that abuts the second end of the plunger from below. Of interest, an upstream end of the electrical connection sub is received within and is pinned to the plunger.

The electrical connection sub includes a bore, which holds a pin connector. The pin connector comprises a non-conductive cylindrical housing, which receives a conductive pin. The downstream end of the wireline is in electrical communication with the upstream end of the conductive pin. A pin connector assembly transmits signals from the electrical wireline down to a signal line associated with a downhole tool.

The bore of the upper sub, the bore of the knife housing, the bore of the plunger and the bore of the electrical connection sub are aligned. Together, they pass signals from the surface, through the wireline cutting tool and through the conductive pin to a signal line associated with the downhole tool and back up to the surface.

The wireline cutting tool may include at least one shear pin that holds the tubular plunger in place along the electrical connection sub. Preferably, the at least one shear pin holding the plunger in place comprises at least two shear pins, with the at least two shear pins being fabricated to shear at the first shear load. More preferably, the shear pins releasably connect the second end of the plunger to the upper end of the electrical connection sub.

In addition, the wireline cutting tool may include at least one shear pin holding the at least one knife in place along the bore of the knife housing. Preferably, the at least one knife comprises a pair of knives disposed on opposing sides of the bore of the knife housing. In this instance, the at least one shear pin holding the at least one knife in place comprises at least one shear pin holding each of the two knives in place, respectively. The shear pins holding the two knives in place are fabricated to shear at the second shear load.

An electrical connection assembly is also provided herein. The electrical connection assembly is described in connection with the use of a wireline cutting tool, but may have utility with other downhole tools. The electrical connection assembly comprises an electrical connection sub, with the electrical connection sub having an upstream end and a downstream end. A pin connector resides within a bore of the electrical connection sub. The pin connector includes a non-conductive housing and an elongated conductive pin. The non-conductive housing is used to insulate the conductive pin from the electrical connection sub.

An end of the conductive pin extends out of the downstream end of the electrical connection sub. This downstream end of the conductive pin is placed in electrical communication with a signal line associated with the downhole tool.

The electrical connection assembly also includes a spring. The spring resides within a bore of the non-conductive housing and is wound around the conductive pin. The spring biases the conductive pin out of the bore of the non-conductive housing.

In one aspect, the electrical connection assembly also comprises a signal line connector. The signal line connector is threadedly connected into the bore of the pin connector at an upstream end of the pin connector. In turn, an upstream end of the signal line connector is placed in electrical communication with a downstream end of a wellbore electric wireline. Signals from the electric wireline flow through the signal line connector, through the conductive pin, and down to the signal line.

A method of cutting a wireline within a wellbore is also provided herein. In one embodiment, the method first includes providing a wireline cutting tool. The wireline cutting tool may be configured in accordance with the tool disclosed above. In this respect, the wireline cutting tool will comprise:

an upper tubular sub;

a knife housing residing within the upper tubular sub;

at least one knife residing within the knife housing;

a lower tubular sub;

a plunger residing within the lower tubular sub; and an electrical connection assembly.

The method also includes providing a downhole tool. The downhole tool may be, for example, a casing collar locator (including a CCL connector sub) or a perforating gun assembly. Preferably, the downhole tool includes a CCL connector sub, a casing collar locator, and then a perforating gun, all forming a tool string.

The method further comprises connecting the downhole tool to the wireline cutting tool. Preferably, connecting the downhole tool to the wireline cutting tool is accomplished by connecting the downhole tool to a lower end of an electrical connection sub. Connecting the downhole tool to the lower end of the electrical connection sub may be accomplished via a threaded connection. At the same time, the plunger is releasably connected to an upper end of the electrical connection assembly.

The method then includes running an electric wireline through a bore of each of the knife housing and the plunger. An armor of the wireline is connected to the plunger. Preferably, this involves stripping away an outer insulating coating of the wireline, at least through the bore of the plunger. At the same time, conductive wires within the wireline are placed in communication with the upstream end of a conductive pin residing within the electrical connection assembly, such as by means of a banana clip. The novel pin connector assembly transmits signals from the wireline, through the conductive pin, and down to a signal line associated with the downhole tool.

The method also comprises pumping the electric wireline, the electrical connection sub, and the downhole tool into the wellbore. Typically, the wellbore will be completed to have a lengthy horizontal section. Many wells today are completed with horizontal sections that exceed one mile. The method then includes conducting a wellbore operation using the downhole tool. The wellbore operation may be, for example, a perforating operation, a plug setting operation, a well-logging operation, a formation fracturing operation, or combinations thereof.

The method may also comprise:

pulling the wireline cutting tool, the electrical connection assembly, and the downhole tool out of the wellbore together by spooling the electric wireline from a surface;

upon detecting that the downhole tool has become stuck in the wellbore, further spooling the wireline at a first shear load, causing the plunger to separate from the electrical connection assembly and travel up a bore of the lower tubular sub, such that the plunger shoulders out against a lower end of the at least one knife;

still further spooling the wireline at a second shear load, causing the at least one knife to travel up the bore of the knife housing and sever the electric line within the wellbore, leaving the downhole tool in place within the wellbore; and still further spooling the wireline in order to remove the wireline from the wellbore.

In connection with the method, the second shear load is greater than the first shear load. Preferably, the shear loads act on shear pins, with one set of shear pins releasably holding the plunger onto the electrical connection assembly and another set of shear pins releasably holding the knives in place along the bore of the knife housing. Beneficially, an upper end of the lower sub may include a grease pocket. Viscous fluid residing inside the grease pocket slows the travel of the plunger up the lower sub en route to the knife housing after the first shear load has been applied.

In the present method, separation of the plunger from the electrical connection assembly also causes the wireline to become separated from the conductive pin. In this way, the wireline is completely freed from the signal line below the wireline cutting tool and the downhole tool string.

In one embodiment, the method further comprises:

running a fishing tool (or "overshot") into the wellbore;

landing the fishing tool onto an upper end of the wireline cutting tool; and pulling the wireline cutting tool and connected downhole tool out of the wellbore.

It is noted that the electrical connection assembly will come out of the wellbore as part of the wireline downhole tool.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1A:
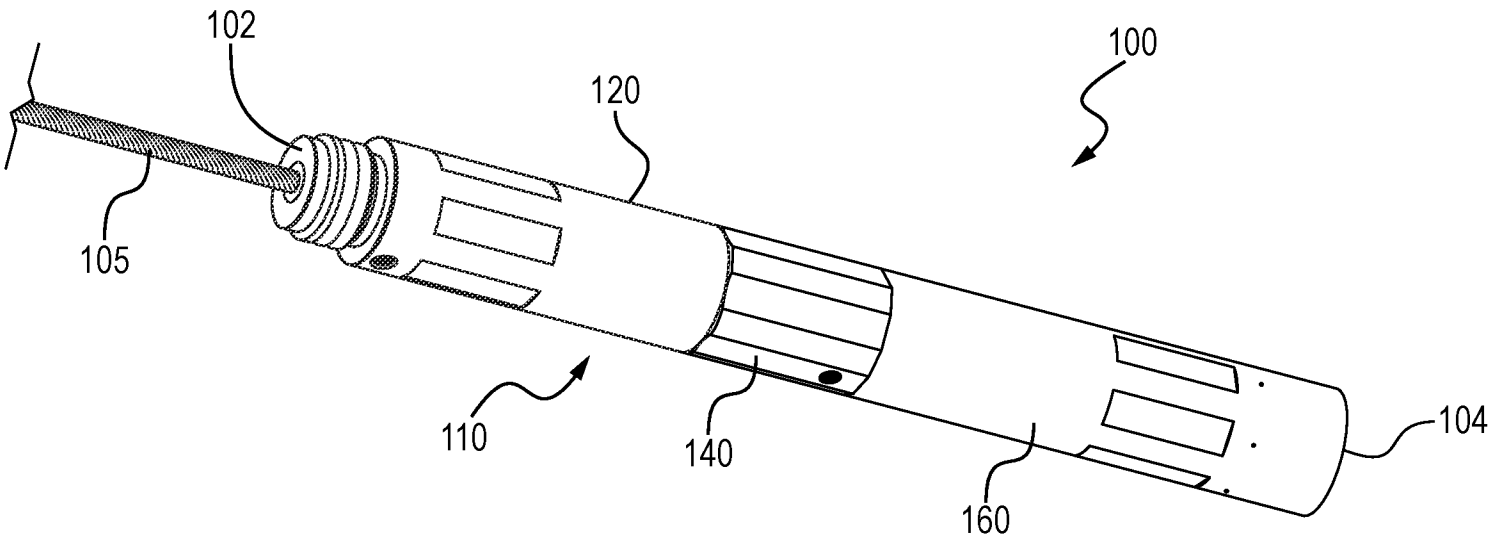
FIG. 1A is a perspective view of an illustrative wireline cutting tool of the present invention in one embodiment. The cutting tool is designed to be placed at the end of an electric wireline and above a downhole tool.

For purposes of the present application, it will be understood that the term "hydrocarbon" refers to an organic compound that includes primarily, if not exclusively, the elements hydrogen and carbon. Examples of hydrocarbon-containing materials include any form of oil, natural gas, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, condensate, coal bed methane, shale oil, shale gas, and other hydrocarbons that are in a gaseous or liquid state. The term hydrocarbon fluids may include other elements, such as, but not limited to, halogens, metallic elements, nitrogen, oxygen, and/or sulfur.

As used herein, the term "fluid" refers to gases, liquids, and combinations of gases and liquids, as well as to combinations of gases and fine solids, and combinations of liquids and fine solids.

As used herein, the term "wellbore fluids" means water, hydrocarbon fluids, formation fluids, or any other fluids that may be within a string of production tubing during a production operation.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type or to a set of geologic strata of different rock types that contribute to or are encountered in, for example, without limitation, (i) the creation, generation, and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section or other cross-sectional shape. As used herein, the term "well," when referring to an opening in the formation, may be used interchangeably with the term "wellbore."

The terms "tubular" or "tubular member," or "sub" refer to any pipe, such as a joint of casing, a portion of a liner, a joint of tubing, a pup joint, or coiled tubing. The terms "production tubing" or "tubing joints" refer to any string of pipe through which reservoir fluids are produced.

DESCRIPTION OF SPECIFIC EMBODIMENTS

FIG. 1A is a perspective view of an illustrative wireline cutting tool 100 of the present invention in one embodiment. The wireline cutting tool 100 is designed to receive an electric wireline 105 that extends from a surface (not shown). The electric wireline 105 supports the wireline cutting tool 100 along with a connected downhole tool (shown at 800 in FIG. 8). The illustrative downhole tool 800 is a casing collar locator or "CCL." However, it is understood that the tool 800 may be, for example, a perforating gun assembly, a cement bond log, a scraper, or other tool.

The wireline cutting tool 100 may also be referred to as a mechanical release tool. The wireline cutting tool 100 is designed to go into a wellbore along with the downhole tool 800 and serves as a release mechanism in the event the downhole tool becomes stuck. It is understood that the downhole tool may be part of a longer tool string that includes, for example, weight bars, a logging tool, and a perforating gun assembly. These tools can become stuck at a dogleg of a horizontally completed well or even in a cork-screw portion of the well.

The wireline cutting tool 100 has a first end 102 and a second end 104 that is opposite the first end 102. In oil and gas parlance, the first end 102 is an upstream end while the second end 104 is a downstream end. The electric wireline 105 passes through the upstream end 102 and is connected internally to a plunger (shown at 150 in FIGS. 5A-5C and in 950 in FIGS. 11A-11C). The plunger, in turn, is pinned to an electrical connection sub (shown at 190 in FIGS. 9C and 12A), described further below.

In the view of FIG. 1A, several components of the wireline cutting tool 100 are visible. These include an upper tubular sub 120, a lower tubular sub 140, and a connector sub 160. Together, the upper sub 120, the lower sub 140, and the connector sub 160 form a tubular body 110. It is understood that the connector sub 160 is used to connect the wireline cutting tool 100 to a lower downhole tool, e.g., the CCL.

Figure 1B:
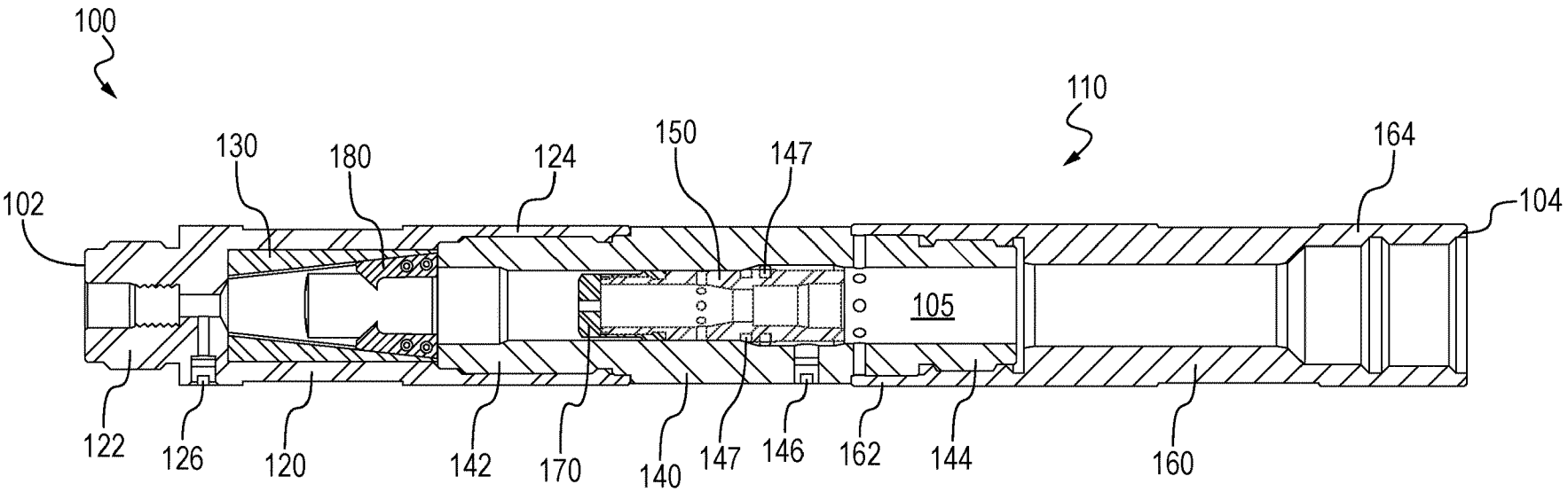
FIG. 1B is a cross-sectional view of the wireline cutting tool of FIG. 1A.

FIG. 1B is a cross-sectional view of the wireline cutting tool 100 of FIG. 1A. The upper sub 120, the lower sub 140, and the connector sub 160 are visible, forming the tubular body 110. Additional components can be seen internal to the tubular body 110. These components include a knife housing 130, a pair of knives 180, and a dart 150. The dart 150 may also be referred to herein as the plunger. An elongated bore 105 extends through the components from the upstream end 102 to the downstream end 104.

Figure 2A:
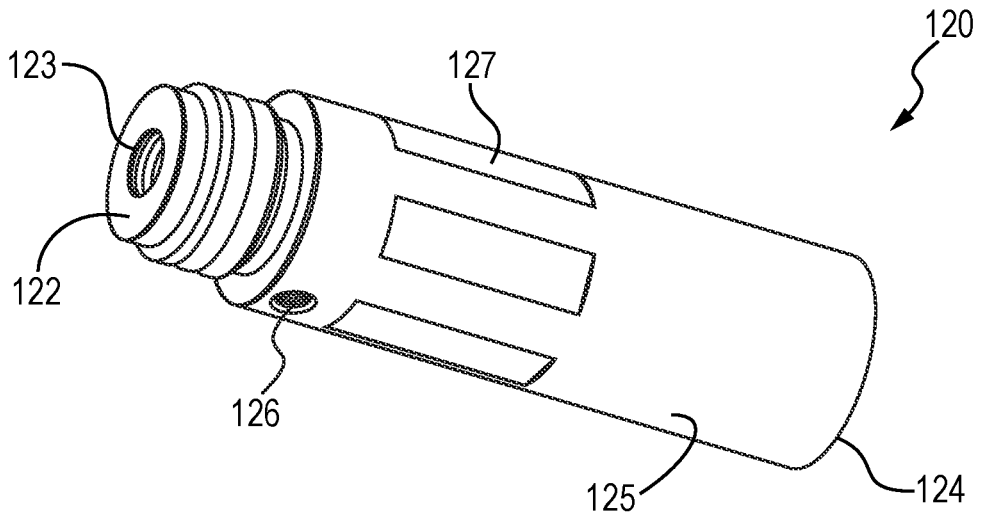
FIG. 2A is a perspective view of an upper tubular sub, which is part of the wireline cutting tool of FIGS. 1A and 1B.

FIG. 2A is a perspective view of the upper tubular sub 120. The upper sub 120 includes a first end 122 and a second end 124 which is opposite the first end 122. The first end 122 may include male threads while the second end 124 may include female threads. The first end 122 may be considered the upstream end while the second end 124 may be considered the downstream end.

The upper sub 120 defines a generally tubular body 125 extending between the first end 122 and second end 124. In one embodiment, the tubular body 125 includes a series of equi-radially disposed flats 127. The flats 127 are useful for turning the tubular body 125 or otherwise tightening the tubular body 125 onto the lower sub 140. Stated another way, and as shown in FIG. 1B, the second end 124 of the upper sub 120 threads onto a first end 142 of the lower sub 140.

Figure 2B:
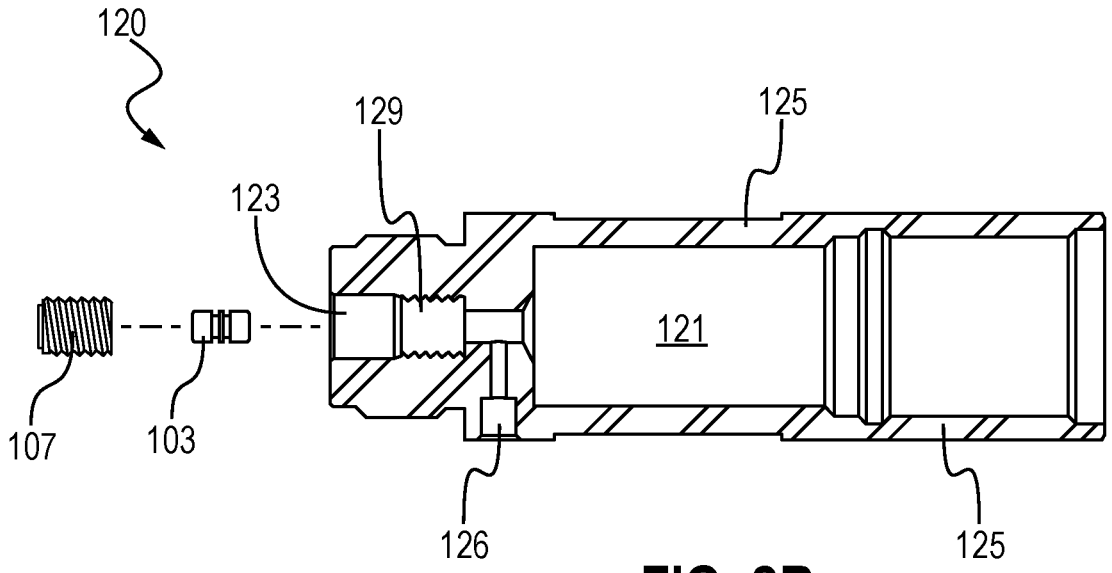
FIG. 2B is a cross-sectional view of the upper tubular sub of FIG. 2A. A hex nut is shown exploded away from a neck of the upper tubular sub.

FIG. 2B is a cross-sectional view of the upper tubular sub 120 of FIG. 2A. An inner bore 121 is seen within the tubular body 125 of the upper sub 120. Also, well-visible in the figure is a first grease port 126. The grease port 126 allows the operator to inject grease through the body 125 and into the bore 121 to lubricate the electric wireline 105. This is particularly helpful since the electric wireline (or cable) 105 traverses across knife blades 184 (shown in FIGS. 3B and 3C described below) en route to the plunger 150 (or the plunger 950 shown in FIGS. 11A-11C described below).

Also visible in FIG. 2B is an upper bore portion 123. The upper bore portion 123 is dimensioned to receive a bushing 103. The bushing 103 contains an opening that slidably receives the electric wireline 105. The opening in the bushing 103 also allows grease to slide along the electric wireline 105. The bushing 103 may also have an outer elastomeric ring, for example an O-ring, (not shown) to assist in providing a seal along the upper bore portion 123.

A hex nut 107 is used to screw the bushing 103 down onto the first end 122 of the upper sub 120. Specifically, outer threads of the hex nut 107 screw into inner threads 129 along the upper bore portion 123, which serve to hold the bushing 103 in place.

Figure 3A:
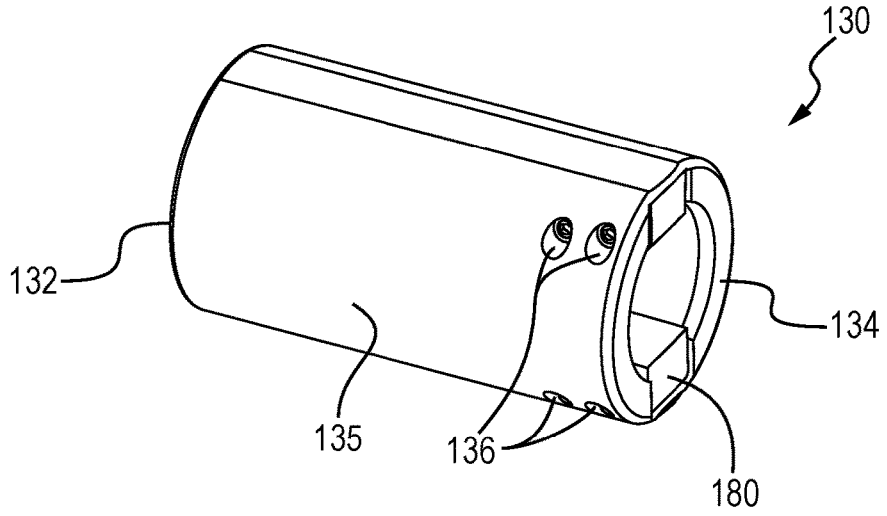
FIG. 3A is a perspective view of a knife housing, which is a part of the wireline cutting tool of FIGS. 1A and 1B and resides within the upper sub.

FIG. 3A is a perspective view of the knife housing 130, which forms a part of the wireline cutting tool 100 of FIG. 1A. The knife housing 130 includes a first end 132 and a second end 134 which is opposite the first end 132. The knife housing 130 defines a generally tubular body 135 extending from the first end 132 to the second end 134.

The tubular body 135 of the knife housing 130 include a series of through-openings 136. The series of through-openings 136 are dimensioned to receive pins (seen at 186 in FIG. 3B). The pins 186, in turn, secure opposing knives 180 in place within the knife housing 130. The pins 186 are designed to sheer at a designated load, referred to herein as a first selected shear load.

Figure 3B:
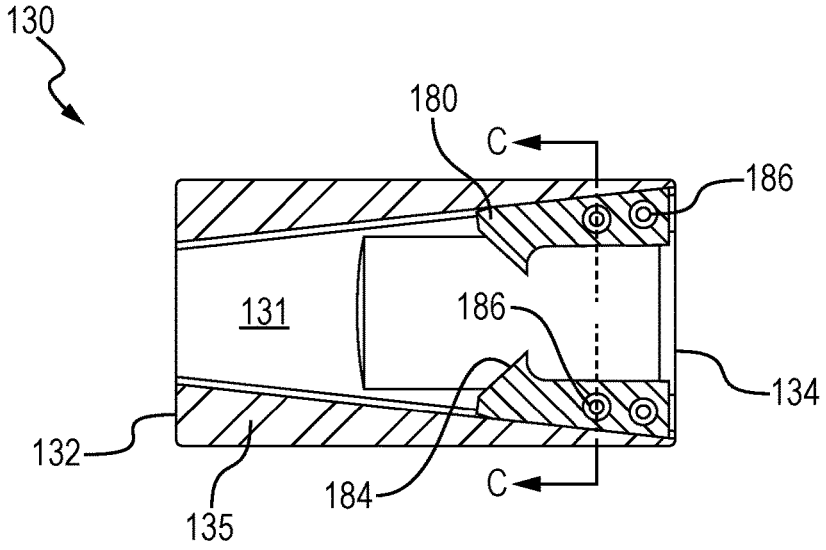
FIG. 3B is a cross-sectional view of the knife housing of FIG. 3A. A pair of knives is visible in the cross-sectional view of FIG. 1B.

FIG. 3B is a cross-sectional view of the knife housing 130 of FIG. 3A. An inner bore 131 is seen within the tubular body 135 of the knife housing 130. The pins 186 are seen within the series of through-openings 136 of the tubular body 135.

It is observed from the cross-sectional view of FIG. 3B that the inner bore 131 is tapered. Specifically, the inner bore 131 becomes narrower as one moves upstream, that is, from the second end 134 towards the first end 132.

Figure 3C:
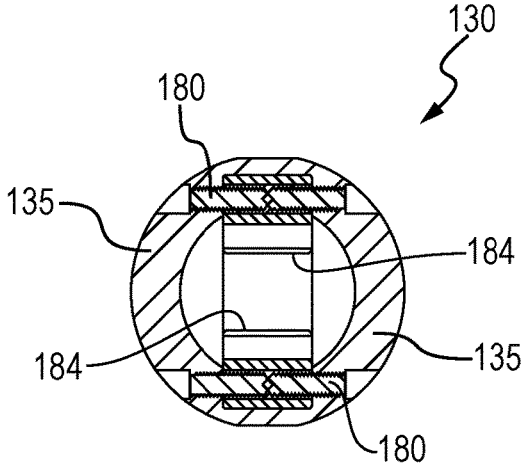
FIG. 3C is another cross-sectional view of the knife housing of FIG. 3A. The cut is taken across Line C-C of FIG. 3B.

FIG. 3C is another cross-sectional view of the knife housing 130 of FIG. 3A. The cut is taken across Line C-C of FIG. 3B. Knives 180 are seen at opposing sides of the tubular body 135. The outer edges of the opposing knife blades 184 are illustrated.

Figure 4A:
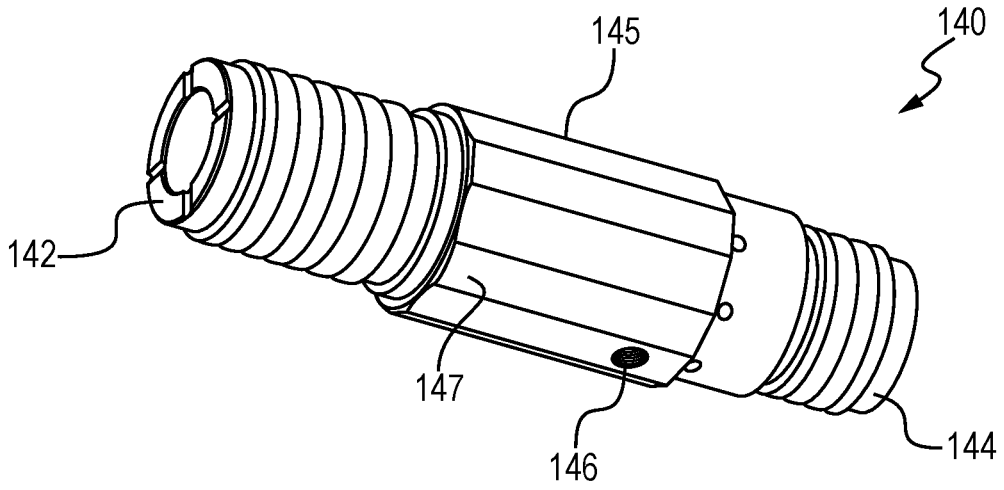
FIG. 4A is a perspective view of a lower sub, which is also a part of the wireline cutting tool of FIGS. 1A and 1B. An upper end of the lower sub connects to a lower end of the upper sub.

FIG. 4A is a perspective view of the lower tubular sub 140, which again is a part of the wireline cutting tool 100 of FIGS. 1A and 1B. The lower tubular sub 140 includes a first end 142 and a second end 144 which is opposite the first end 142. The first end 142 may include male threads while the second end 144 may also include male threads.

The lower tubular sub 140 defines a generally tubular body 145 between the first 142 and second 144 ends. As shown in FIG. 1B, the first end 142 connects to the second end 124 of the upper sub 120, while the second end 144 connects to a first end 162 of the connector sub 160 (discussed below in reference to FIG. 6A). In one embodiment, the tubular body 145 includes a series of equi-radially disposed flats 147. The flats 147 are useful for turning the tubular body 145 or otherwise tightening the tubular body 145 onto the upper sub 120 above and the connector sub 160 (or other downhole tool) below.

Figure 4B:
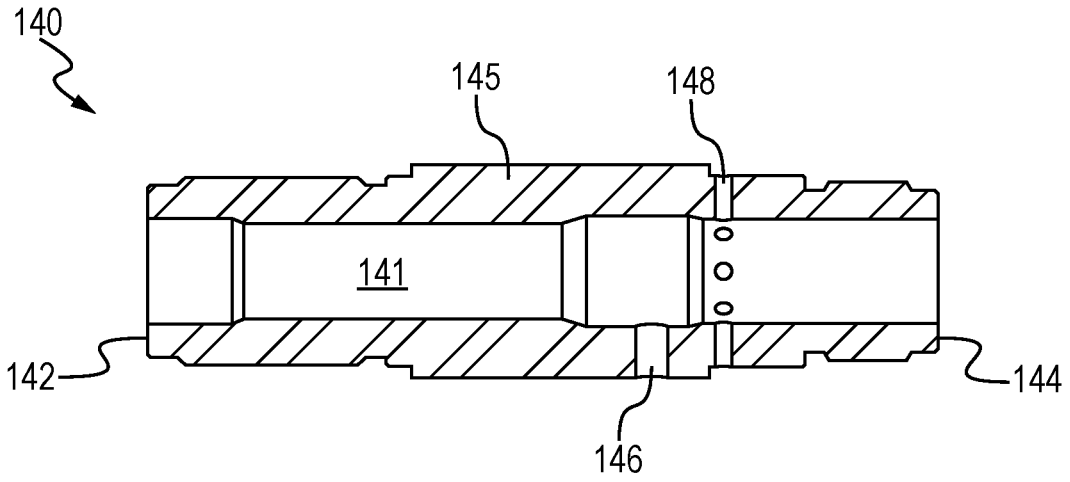
FIG. 4B is a cross-sectional view of the lower sub of FIG. 4A.

FIG. 4B is a cross-sectional view of the lower sub 140 of FIG. 4A. An inner bore 141 is seen within the body 145 of the lower sub 140. Also of interest, a second grease port 146 is provided. The grease port 146 enables the operator to inject grease into the inner bore 141 of the tubular body 145. A plurality of equi-radially disposed vent ports 148 are also provided through the body 145. These provide pressure balancing as the dart body (seen at 155 in FIG. 5A) moves up the inner bore 141 of the tubular body 145 during operation of the wireline cutting tool 100.

Figure 5A:
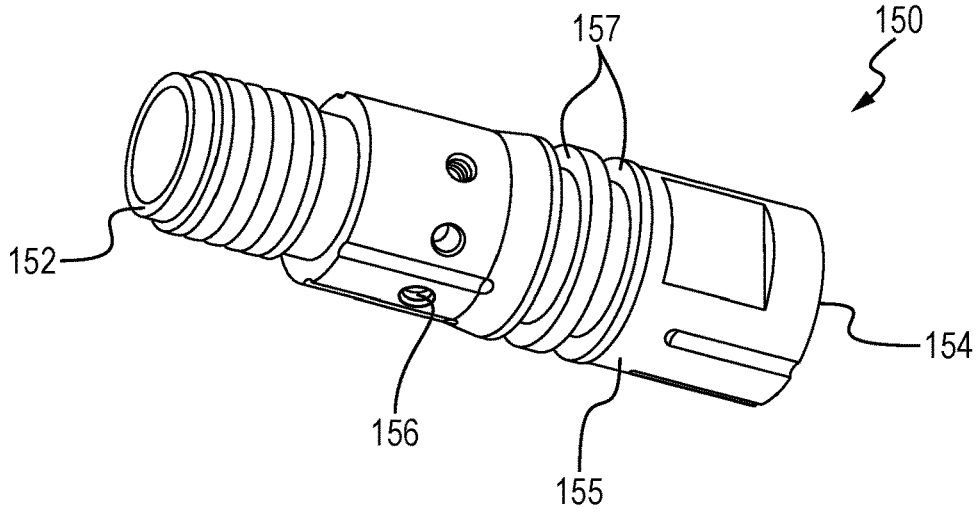
FIG. 5A is a perspective view of a dart, which is also a part of the wireline cutting tool of FIGS. 1A and 1B. The dart resides within the lower sub.

The inner bore 141 of the lower sub 140 is dimensioned to hold a dart 150. FIG. 5A is a perspective view of the dart 150. The dart 150 includes a first end 152 and a second end 154 opposite the first end 152. The dart 150 defines a generally tubular body 155 extending from the first 152 end to the second 154 end. The dart 155 may be referred to as a "socket body" as it generally resembles a socket.

Figure 5B:
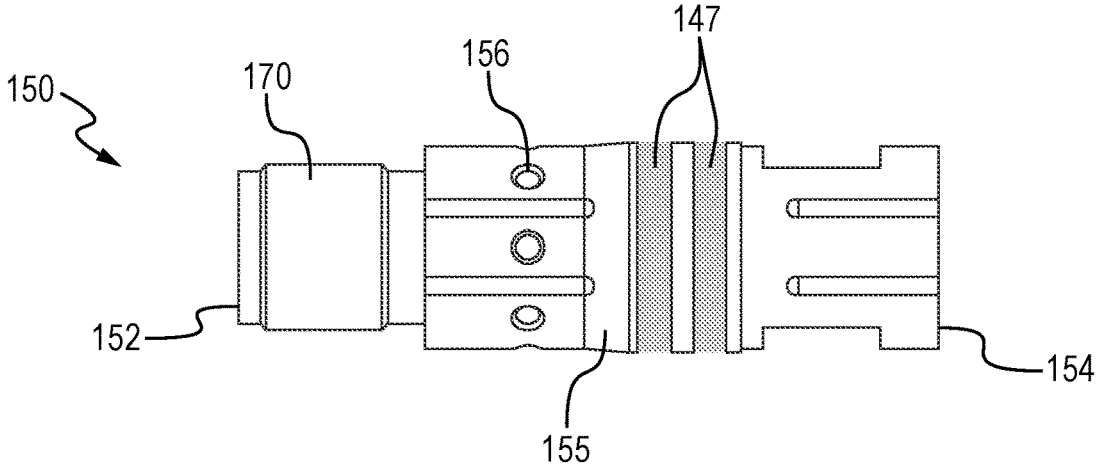
FIG. 5B is a side view of the dart of FIG. 5A. Here, O-rings have been added to the dart.
Figure 5C:
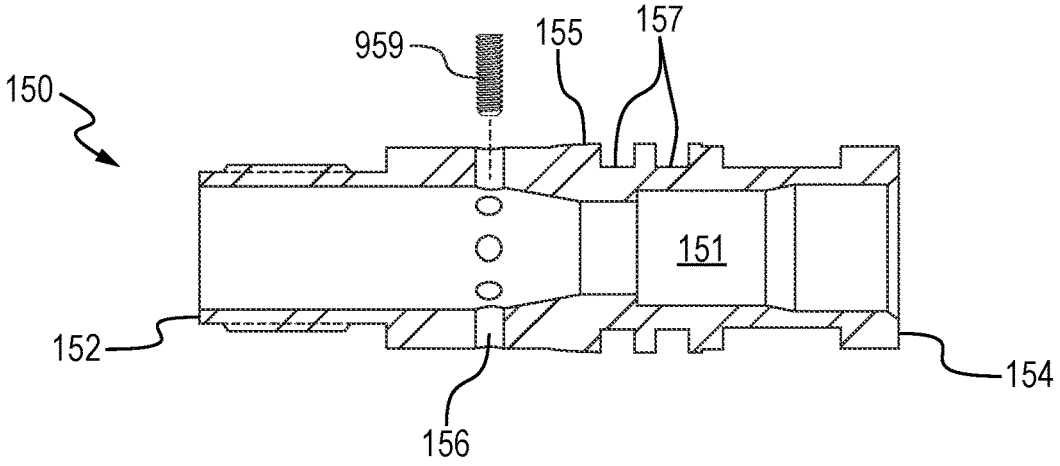
FIG. 5C is a cross-sectional view of the dart of FIG. 5A.

FIG. 5B is a side view of the dart 150 of FIG. 5A, while FIG. 5C is a cross-sectional view. It can be seen that the socket body 155 of the dart 150 includes a pair of radial recesses 157. The radial recesses 157 are dimensioned to receive O-rings, seen at 147 in FIG. 5B. The O-rings 147 provide a fluid seal between the dart 150 and the surrounding lower sub 140. At the same time, the O-rings 147 permit the socket body 155 to slide up the bore 141 of the lower sub 140.

Figure 7A:
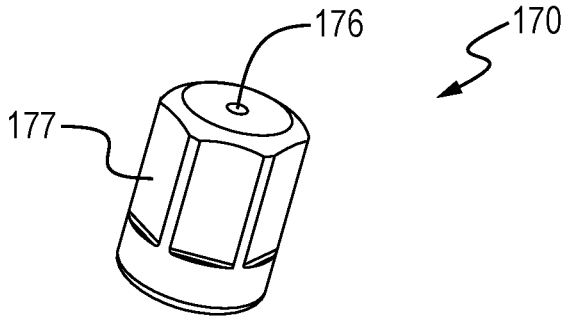
FIG. 7A is a perspective view of a dart cap. The dart cap is also a part of the wireline cutting tool of FIGS. 1A and 1B. The dart cap is visible in the cross-sectional view of FIG. 1B.
Figure 7B:
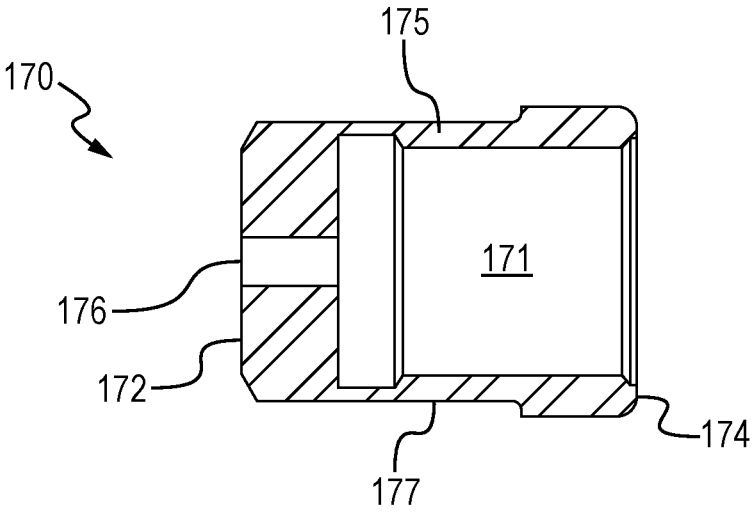
FIG. 7B is a cross-sectional side view of the dart cap of FIG. 7A.

It can also be seen that a cap 170 has been placed over the upstream end 152 of the dart 150. The cap 170 is a dart cap and is screwed onto the threads at the upstream end 152. FIG. 7A is a perspective view of the dart cap 170, while FIG. 7B is a side, cross-sectional view of the dart cap 170 of FIG. 7A. The cap 170 is also visible in FIG. 1B. It is observed in each view that a through-opening 176 is provided in the cap 170 to accommodate the electric wireline 105.

Returning to FIG. 5B, it can also be seen that a series of through-openings 156 is provided in the socket body 155 of the dart 150. The series of through-openings 156 receive shear pins 959 (shown in FIG. 5C). The shear pins 959 releasably connect the dart 150 to an electrical connection sub, described below in connection with FIGS. 9A-9C. The shear pins 959 are designed to break at the first selected shear load.

FIG. 5C is a cross-sectional view of the dart 150 of FIGS. 5A and 5B. An inner bore 151 is seen within the socket body 155 of the dart 150. The inner bore 151 accommodates the electric wireline 105 as it passes through the through-opening 176 of the cap 170 and then through the dart 150. Here, the O-rings 147 have been removed.

Figure 9A:
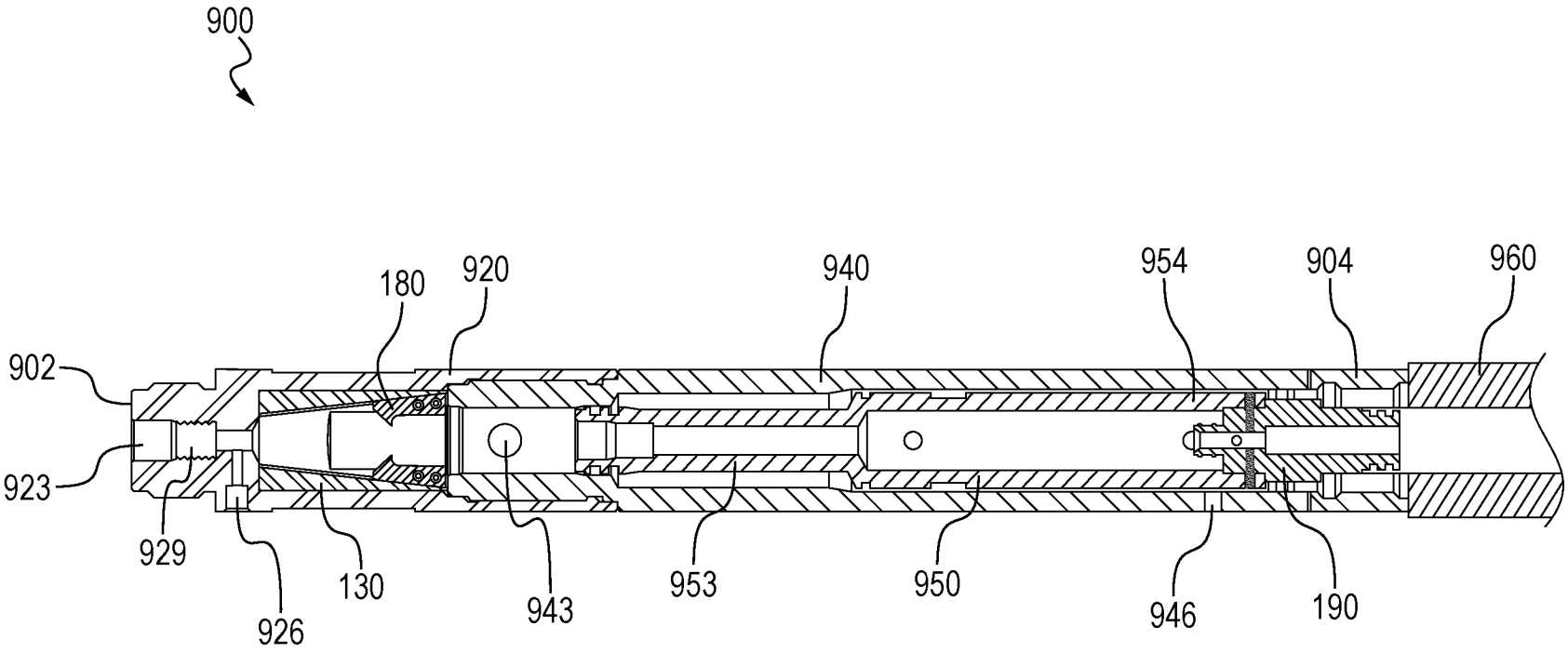
FIG. 9A is a cross-sectional view of a wireline cutting tool of the present invention in an alternate embodiment. In this embodiment, the wireline cutting tool uses an elongated plunger rather than the short dart of FIG. 5B.
Figure 9B:
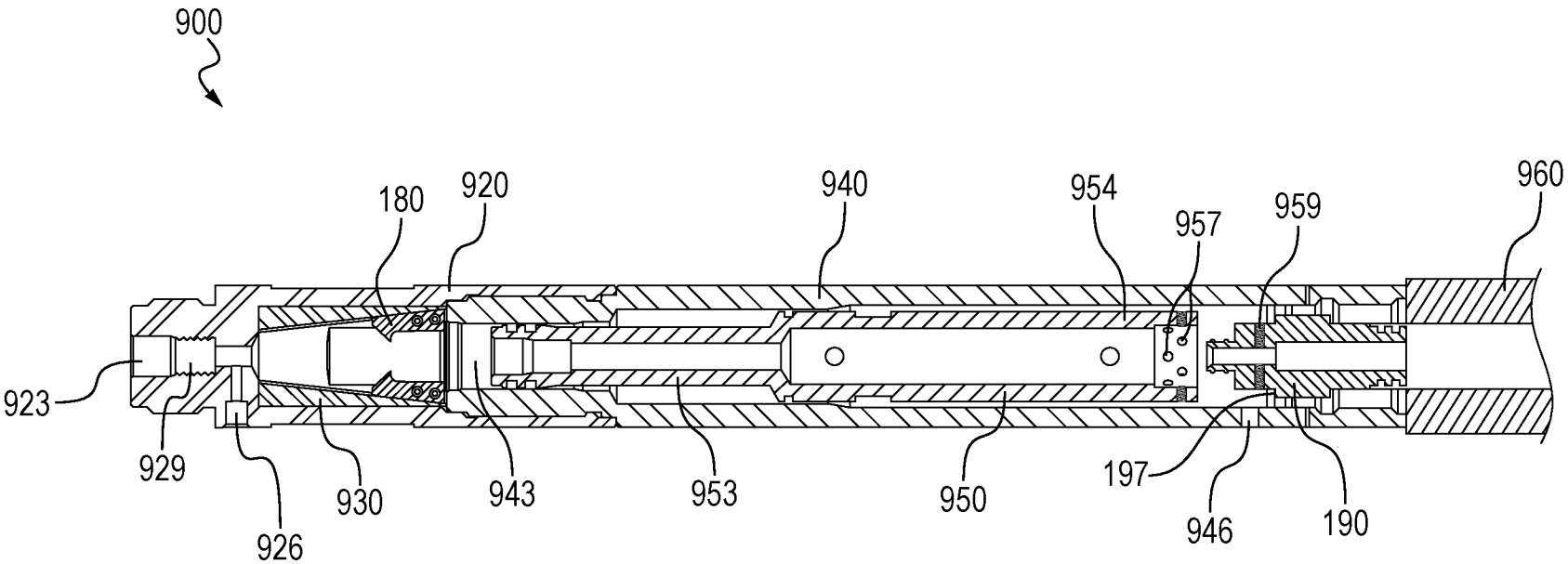
FIG. 9B is another cross-sectional view of the wireline cutting tool of FIG. 9A. Here, a first shear load has been applied to the tool, resulting in a separation of the plunger from the electrical connection sub.
Figure 9C:
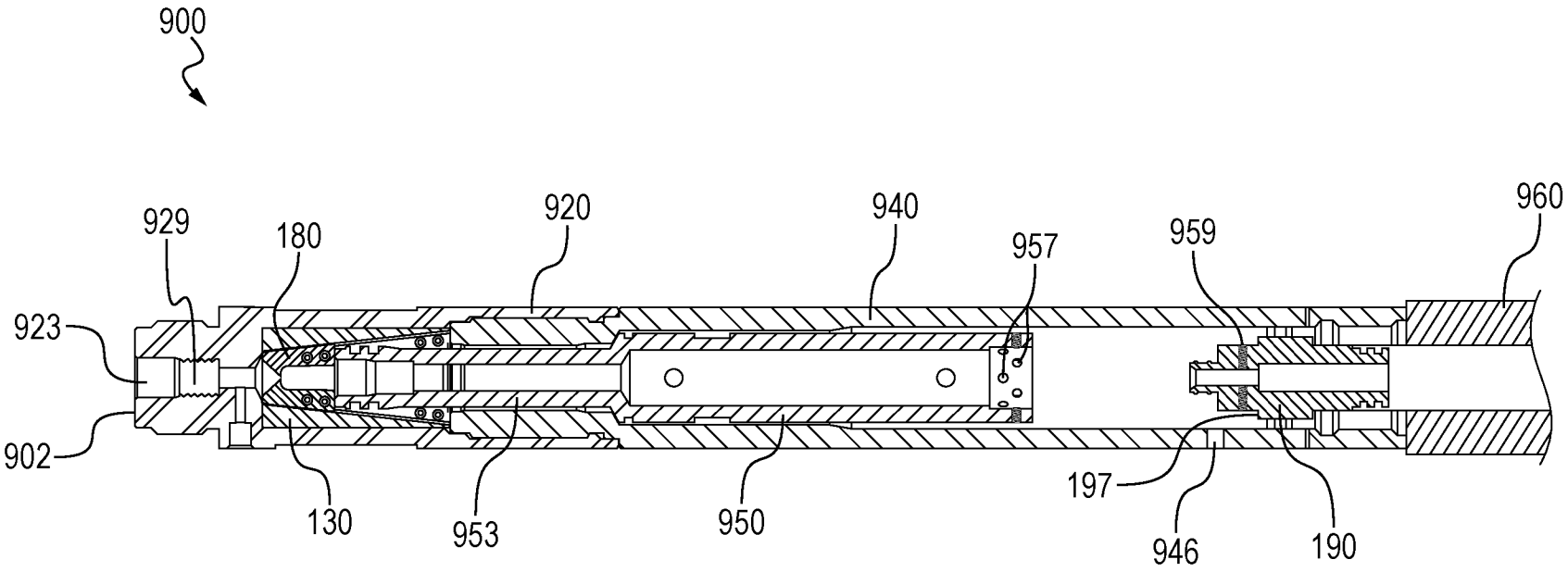
FIG. 9C is yet another cross-sectional view of the wireline cutting tool of FIG. 9A. Here, a second shear load has been applied to the tool, resulting in a sliding of knives up the knife housing. This sliding of knives up the knife housing is in response to a mechanical force applied by the plunger. This severs the wireline.
Figure 12A:
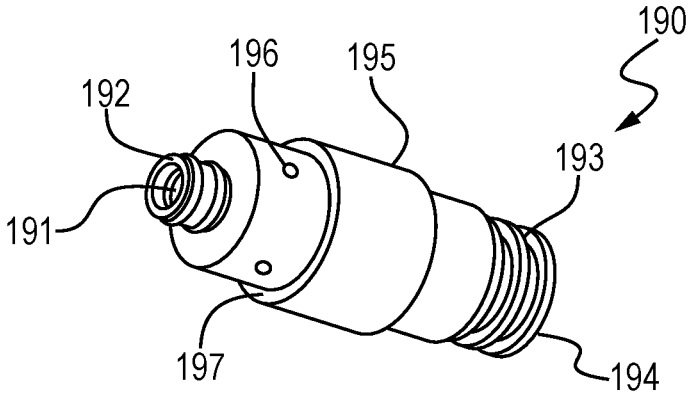
FIG. 12A is a perspective view of an electrical connection sub, which is used in connection with the wireline cutting tools of FIGS. 1A and 1B, and FIGS. 9A, 9B, and 9C.

As noted earlier, the second (or lower) end 154 of the dart 150 is dimensioned to receive an upper end of the electrical connection sub 190 (shown in FIGS. 9C and 12A). The dart 150 is pinned to the electrical connection sub 190 using the shear pins 959.

Figure 6A:
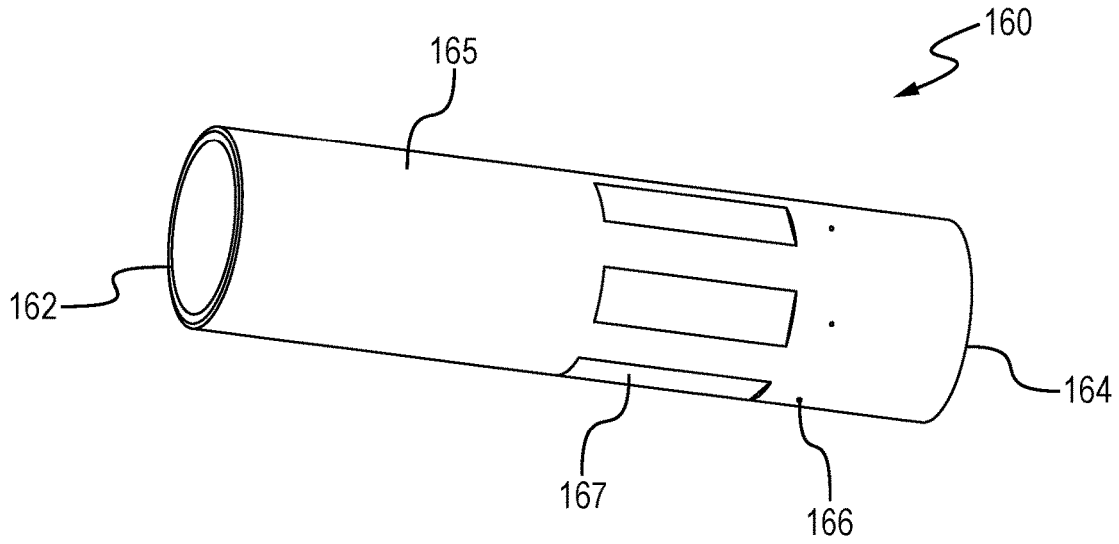
FIG. 6A is a perspective view of a connector sub. The connector sub connects the lower sub of FIG. 4A to a separate downhole tool (not shown).

FIG. 6A is a perspective view of the connector sub 160. The connector sub 160 connects the lower sub 140 of FIG. 4A to a separate downhole tool. The separate downhole tool may be, for example, a casing collar locator or "CCL" (shown at 800 in FIG. 8). In this instance, the connector sub 160 is a CCL connector sub.

The connector sub 160 includes a first end 162 and a second end 164 opposite the first end 162. Each of the first 162 and second 144 ends defines female threads. As noted above, the first end 162 of the connector sub 160 connects to the second end 144 of the lower tubular sub 140.

The connector sub 160 defines a generally tubular body 165 between the first 162 and second 164 ends. In one embodiment, the tubular body 165 includes a series of equi-radially disposed flats 167. The flats 167 are useful for turning the tubular body 165 or otherwise tightening the tubular body 165 onto the lower sub 140 above and the CCL 800 below.

Figure 6B:
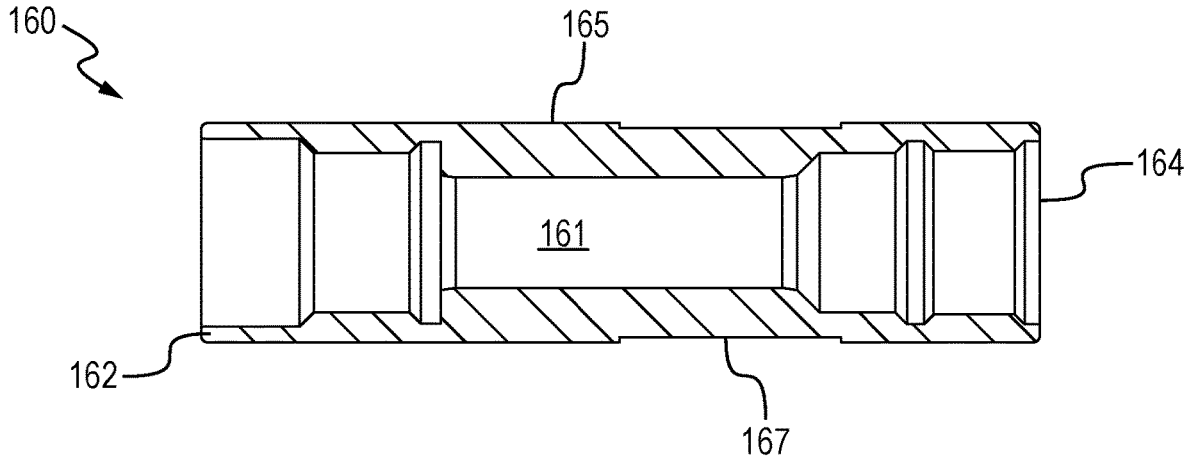
FIG. 6B is a cross-sectional view of the connector sub of FIG. 6A.

FIG. 6B is a cross-sectional view of the connector sub 160 of FIG. 6A. An inner bore 161 is seen within the tubular body 165 of the connector sub 160. Of interest, a plurality of equi-radially disposed vent ports 166 are provided through the tubular body 165. The vent ports 166 provide pressure balancing during operation of the downhole tool.

Returning again to FIGS. 7A and 7B, it can be seen that the dart cap 170 has a first end 172 and a second end 174. Internal to the cap 170 is a bore 171. As shown in FIG. 1B, the bore 171 receives the first end 142 of the dart 150. Flat surfaces 177 are disposed around the cap 170 to facilitate attachment of the cap 170 onto the upstream end 152 of the dart 150. A means for attachment may include screwing the cap 170 onto the upstream or first end 152 of the dart 150.

Figure 8:
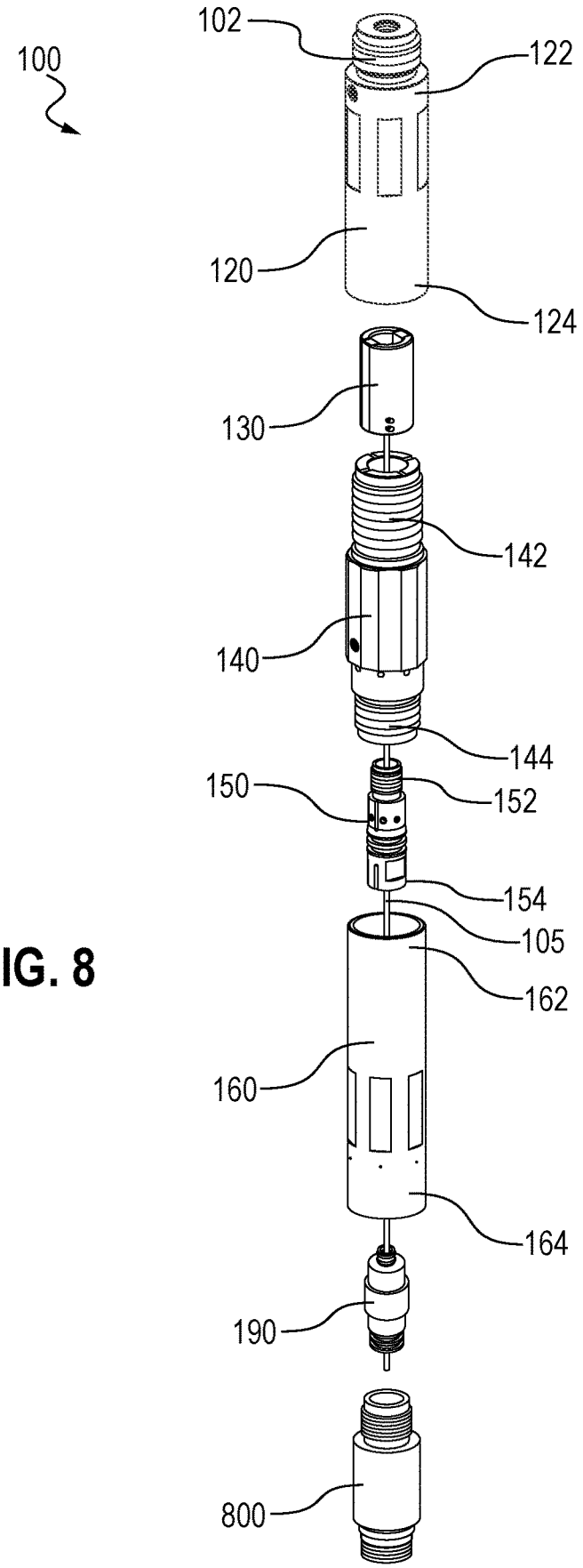
FIG. 8 is another perspective view of the wireline cutting tool of FIGS. 1A and 1B. Here, selected components of the tool are presented in exploded-apart relation. An electrical connection sub and an illustrative casing collar locator are provided at the bottom of the view.

FIG. 8 is another perspective view of the wireline cutting tool 100 of FIGS. 1A and 1B. Here, selected components of the wireline cutting tool 100 are presented in exploded-apart relation. Detailing components from the upstream end 102 to the downstream end 104, these include the upper tubular sub 120, the knife housing 130, the lower tubular sub 140, the dart 150, and the connector sub 160.

An electrical connection sub 190 and an illustrative casing collar locator 800 are provided at the bottom of the view. The electrical connection sub 190 is shown in more detail in FIGS. 12A-12C, described below.

The wireline cutting tool 100 described above is just one possible embodiment for providing a two-step mechanical release tool. The two steps represent the first shear load that separates the dart 150 from the electrical connection sub 190 followed by a second shear load that moves the knives 180 from a lower position within the knife housing 130 to an upper position. Moving the knives 180 up the upper sub 120 moves the knife blades 184 closer together, severing the electric wireline 105.

FIG. 9A is a cross-sectional view of a two-step wireline cutting tool 900 of the present invention in an alternate embodiment. The wireline cutting tool 900 includes a first, or upstream end 902. The upstream end 902 includes a fishing neck. The cutting tool 900 also includes a second, or downstream end 904. The downstream end 904 connects to a connector sub 960, which may be in accordance with sub 160 of FIG. 6A.

As with the wireline cutting tool 100 of FIG. 1A, the wireline cutting tool 900 of FIG. 9A includes an upper tubular sub 920. The upper tubular sub 920 is essentially in accordance with upper sub 120. Thus, details of the upper tubular sub 920 need not be repeated. An upper bore portion is indicated here at 923, with threads shown at 929. The upper bore portion 923 will receive the bushing 103 and hex nut 107 of FIG. 2B. A first grease port is also again seen (here shown at 926).

Figure 10A:
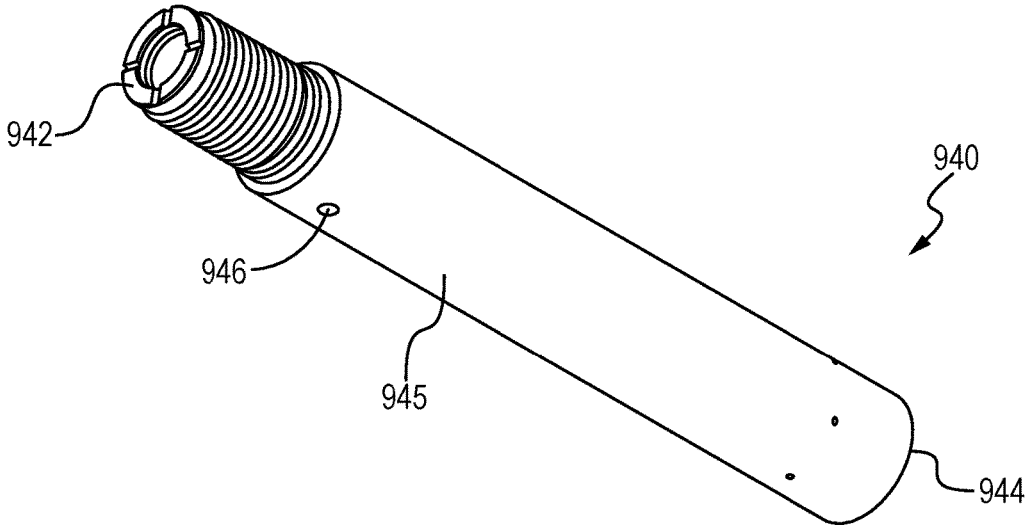
FIG. 10A is a perspective view of a lower tubular sub, which is part of the wireline cutting tool of FIGS. 9A, 9B, and 9C.

As with the wireline cutting tool 100 of FIG. 1A, the wireline cutting tool 900 of FIG. 9A also includes a lower tubular sub 940. FIG. 10A is a perspective view of the lower tubular sub 940. The lower sub 940 includes a first end 942 and a second end 944, which is opposite the first end 942. The first end 942 includes male threads while the second end 944 defines female threads. The lower sub 940 defines a generally tubular body 945 between the first 942 and second 944 ends. The first end 942 connects to a second end 924 of the upper tubular sub 920 (shown in FIG. 15B), while the second end 944 connects to the connector sub 960.

Figure 10B:
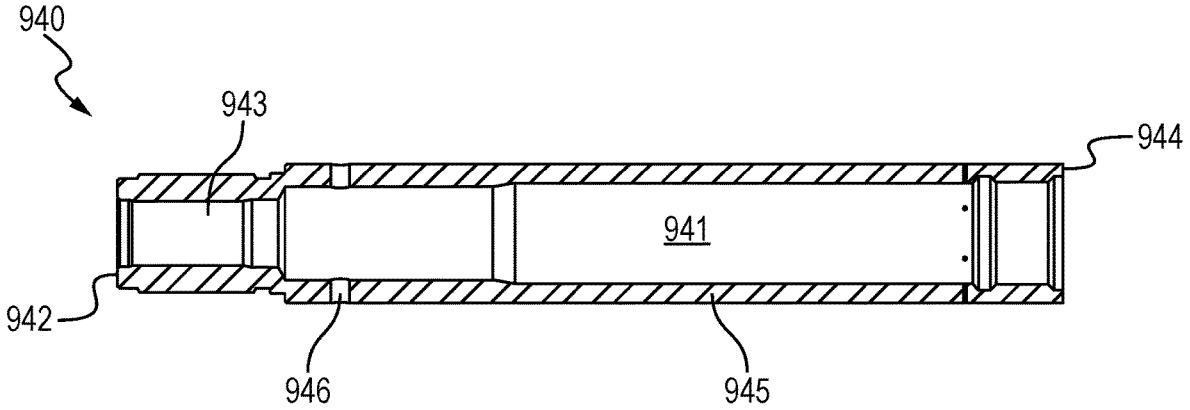
FIG. 10B is a cross-sectional view of the lower tubular sub of FIG. 10A.

FIG. 10B is a cross-sectional view of the lower tubular sub 940 of FIG. 10A. An inner bore 941 is seen within the tubular body 945 of the lower tubular sub 940. Also of interest, a second grease port 946 is provided. The second grease port 946 enables the operator to inject grease into the bore 941 of the tubular body 945 as discussed above in connection with the lower sub 140. Grease travels into an upper area referred to as a grease trap 943. The lower tubular sub 940 otherwise functions as sub 140 and additional details need not be repeated.

Figure 11A:
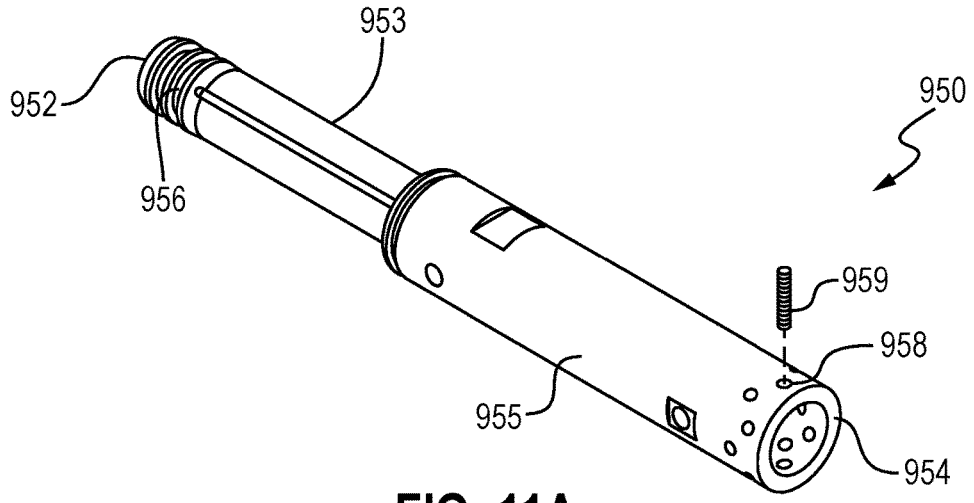
FIG. 11A is a perspective view of a plunger, which is part of the wireline cutting tool of FIGS. 9A, 9B, and 9C. The plunger resides within the lower sub but extends partially up into the upper sub.

Residing within the lower tubular sub 940 is a plunger 950. FIG. 11A is a perspective view of the plunger 950 from FIG. 9A. The plunger 950 includes a first end 952 and a second end 954 opposite the first end 952. The first end 952 defines an elongated portion having a reduced outer diameter, seen at 953. The elongated portion 953 is designed to advance into the upper tubular sub 920, where the first, or upstream, end 952 will engage the knives 180.

Figure 11B:
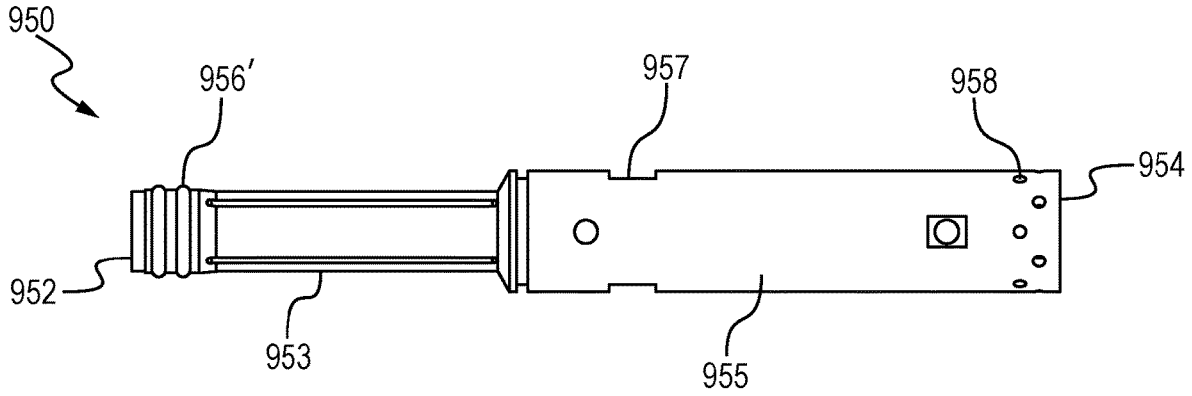
FIG. 11B is a side view of the plunger of FIG. 11A. Here, O-rings have been added at the upstream end.
Figure 11C:
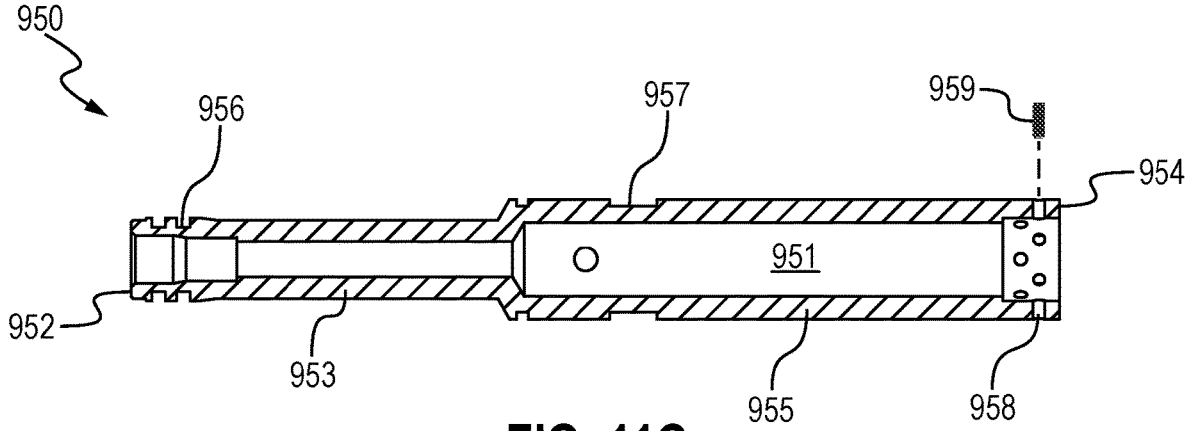
FIG. 11C is a cross-sectional view of the plunger of FIG. 11A. The O-rings have been removed.

FIG. 11B is a side view of the plunger 950 of FIG. 11A. FIG. 11C is a cross-sectional view of the plunger 950 of FIG. 11A.

It can be seen that the first end 952 includes recessed portions 956. The recessed portions 956 are designed to receive O-rings 956' (seen in FIG. 11B). With the O-rings 956' in place, a seal is provided along an annular region between the elongated portion 953 and the grease trap portion 943 of the surrounding bore 941 of the lower sub 940.

The plunger 950 defines a generally tubular body 955 extending from the first end 952 to the second end 954. Movement of the plunger 950 through the surrounding bore 941 of the lower sub 940 and up the wireline cutting tool 900 is inhibited, or at least slowed, by the presence of grease in the grease trap 943.

The second end 954 of the plunger 950 is dimensioned to receive an upper end of the electrical connection sub (seen at 190 in FIG. 8 and in FIG. 12A). The second end 954 includes holes 958 configured to receive shear pins 959. The shear pins 959 extend into aligned holes 196 located in a body 195 of the electrical connection sub 190 (seen in FIGS. 12A-12C and 12I. Thus, the shear pins 959 secure the plunger 950 in place during normal operation of the downhole tool.

The shear pins 959 will shear when tension at the first shear load is applied to the electric wireline 105. This will cause the plunger 950 to become disconnected from the electrical connection sub 190 and move up the lower sub 940. As the elongated portion 953 of the plunger 950 advances towards the knife housing 130, it travels through the grease trap 943. The displaced grease enters a bore 951 of the plunger 950. However, due to the small inner diameter of the bore 951 along the elongated portion 953, displacement takes place very slowly. This significantly impedes the travel time of the plunger 950, protecting the knife housing 130 and knives 180 from violent contact with the plunger 950 when tension at the first shear load is applied to the electric wireline 105.

It is observed that, as a matter of designer's choice, the rate of advance of the plunger 950 towards the knife housing 130 may be manipulated by (i) changing the viscosity of the grease (or other fluid medium) in the grease trap 943 or (ii) adjusting the inner diameter of the upper portion 953 of the plunger 950. The rate of advance may also be manipulated by the operator at the surface based on (iii) the amount of tension applied to the electrical wireline 105.

Flats 957 are provided along the body 955 of the plunger 950. The flats 957 provide a point of torque for a wrench or other tightening tool.

FIG. 9B is another cross-sectional view of the wireline cutting tool 900 of FIG. 9A. Here the first shear load has been applied to the wireline cutting tool 900. This results in a separation of the plunger 950 from the electrical connection sub 190. Shear pins (shown at 959 in FIG. 11C) have sheared, releasing the plunger 950. The wireline 105 is now pulling the plunger 950 up through the bore 941 of the lower sub 940.

FIG. 12A is a perspective view of the electrical connection sub 190, which is used in connection with both of the wireline cutting tools 100 and 900 of FIGS. 1A and 1B and FIGS. 9A, 9B, and 9C, respectively. The electrical connection sub 190 resembles a spark plug. It is observed that the electrical connection sub 190 includes a body 195 having a first end 192 and a second end 194, which is opposite the first end 192.

As shown in FIG. 9A, the first end 192 is dimensioned to slide into the second (or lower) end 944 of the lower sub 940. Seals are optionally provided around an outer diameter of the first end 192. A shoulder 197 is formed around the body 195. The lower end 954 of the plunger 950 will "shoulder out" against this shoulder 197.

Figure 12B:
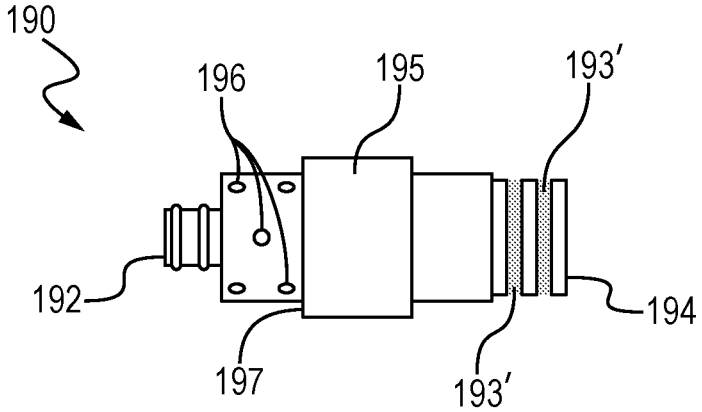
FIG. 12B is a side view of the electrical connection sub of FIG. 12A.

FIG. 12B is a side view of the electrical connection sub 190 of FIG. 12A. Here, O-rings 193' are added around recesses 193 at the downstream end 194. In each of FIGS. 12A and 12B, holes 196 are visible above the shoulder 197. The holes 196 are configured to align with through-openings 958 and may be configured to receive the shear pins 959.

Figure 12C:
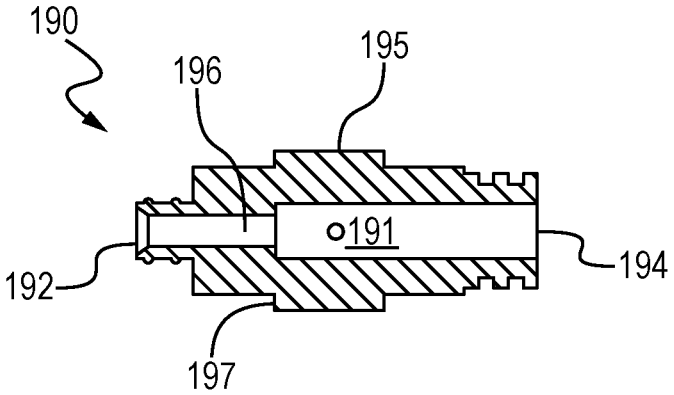
FIG. 12C is a cross-sectional view of the electrical connection sub of FIG. 12A.

FIG. 12C is a cross-sectional view of the electrical connection sub 190 of FIG. 12A. An elongated bore 191 is seen extending through the electrical connection sub 190 from the first end 192 down to the second end 194.

Figure 12D:
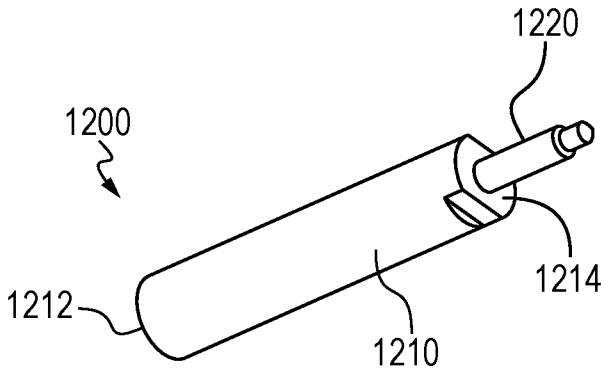
FIG. 12D is a perspective view of a pin connector that resides within the electrical connection sub of FIG. 12A. The pin connector comprises a conductive pin extending from a non-conductive housing.

FIG. 12D is a perspective view of a pin connector 1200. The pin connector 1200 is dimensioned to reside along the bore 191 of the electrical connection sub 190. The pin connector 1200 first comprises an elongated housing 1210. The elongated housing 1210 defines a cylindrical body that is fabricated from a non-conductive material such as PEEK (polyetheretherketone) or other suitable material. The housing 1210 has an upstream end 1212 and a downstream end 1214.

The pin connector 1200 also includes a conductive pin 1220. The conductive pin 1220 resides within a bore of the cylindrical body 1210 and extends out of the downstream end 1214 of the housing. The bore is shown at 1215 of FIG. 12E.

Figure 12E:
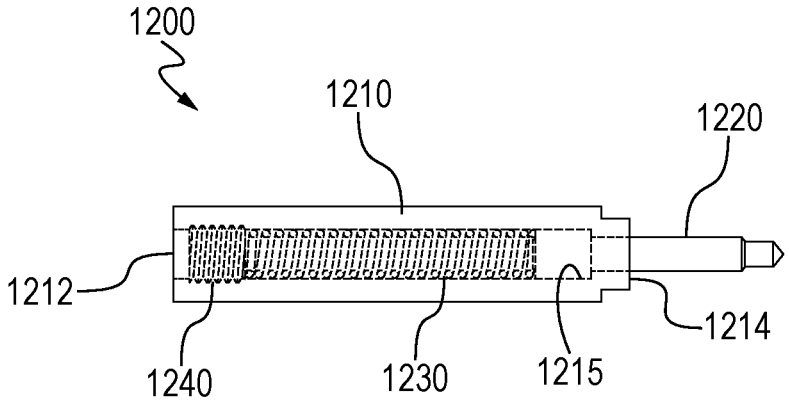
FIG. 12E is a side view of the pin connector of FIG. 12D. A spring is shown in phantom.

FIG. 12E is a side view of the pin connector 1200 of FIG. 12D. It can be seen that a spring 1230 resides within the bore 1215 of the housing 1210. The spring 1230 is wrapped around the conductive pin 1220 and is maintained in compression. The spring 1230 urges the conductive pin 1220 out of the bore 1215 of the non-conductive housing 1210 downstream from the electrical connection sub 190. The spring 1230 is chosen such that a force applied to the conductive pin 1220 is suitable to maintain an extended position of the conductive pin 1220 out of the bore 1215 of the non-conductive housing 1210 and out of the downstream end 194 of the electrical connection sub 190.

Figure 12F:
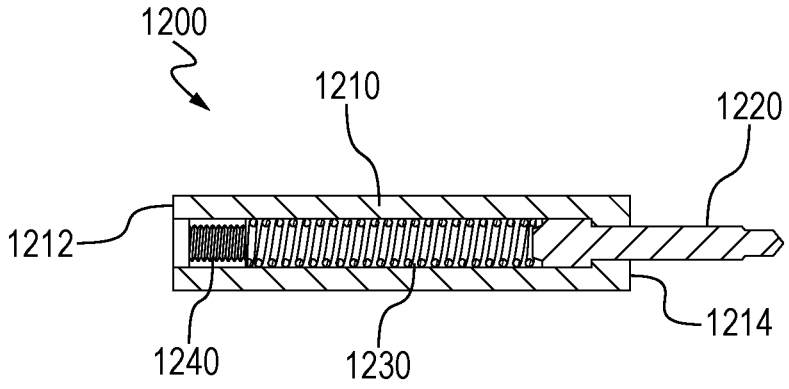
FIG. 12F is a side, cross-sectional view of the pin connector of FIG. 12D.

FIG. 12F is a cross-sectional view of the pin connector 1200 of FIG. 12D. Visible in this view is a threaded portion 1240 of the bore 1215. The threaded portion 1240 resides at the upstream end 1212 of the housing 1210.

Figure 12G:
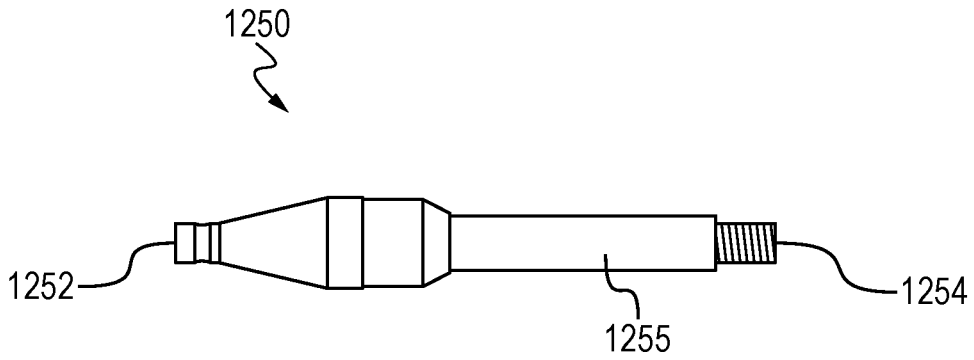
FIG. 12G is a side view of a signal line connector. The signal line connector is designed to thread into the bore of the pin connector of FIG. 12D.

FIG. 12G is a side view of a signal line connector 1250. The signal line connector 1250 has an upstream end 1252 and a downstream end 1254. The downstream end 1254 comprises threads that connect to the female threads 1240 of the non-conductive housing 1210. Thus, the signal line connector 1250 is designed to thread into the pin connector 1200.

The conductive pin 1220 of the pin connector 1200 connects to a signal line (not shown) associated with the downhole tool 800. This provides for a quick electrical connection such as by means of a banana clip, splicing, or soldering. At the same time, the upstream end 1252 of the signal line connector 1250 is connected to a lowest end of the wireline 105. This preferably is done by splicing to ensure a proper electrical connection between the components.

Figure 12H:
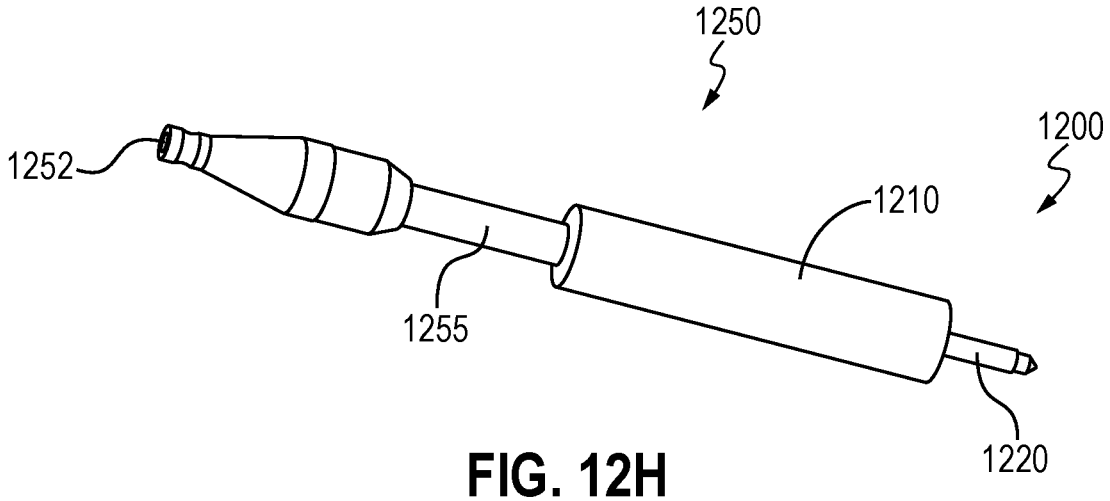
FIG. 12H is a perspective view of components of the pin connector assembly with the signal line connector being threaded into the bore of the pin connector of FIG. 12A.

FIG. 12H is a perspective view of the pin connector 1200 and the signal line connector 1250. It is noted that the signal line connector 1250 includes a stem 1255. The stem 1255 includes a durable outer layer (not shown) that protects the electrical wireline 105 within.

Figure 12I:
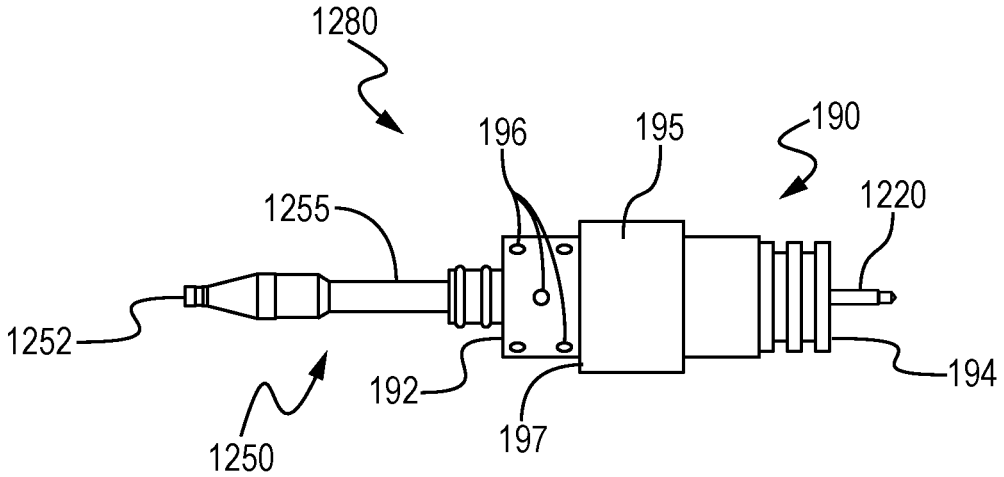
FIG. 12I is a perspective view of the pin connector assembly having been fully assembled. The electrical connection sub has received the signal line connector.

FIG. 12I is a perspective view of a pin connector assembly 1280 having been fully assembled. The pin connector assembly 1280 includes the electrical connection sub 190, the pin connector 1200, and the signal line connector 1250. The electrical connection sub 190 has received the electrically conductive pin 1220 and the signal line connector 1250.

The pin connector assembly 1280 is used to transmit signals up and down the wellbore through the wireline cutting tool 900. Such signals may include:

- detonation signals sent downhole to perforating guns;
- set signals sent to a setting tool for a plug;
- signals sent from a formation logging tool back up to the surface; and
- signals sent from a downhole sensor, such as a microphone or temperature sensor, back up to the surface.

Figure 12J:
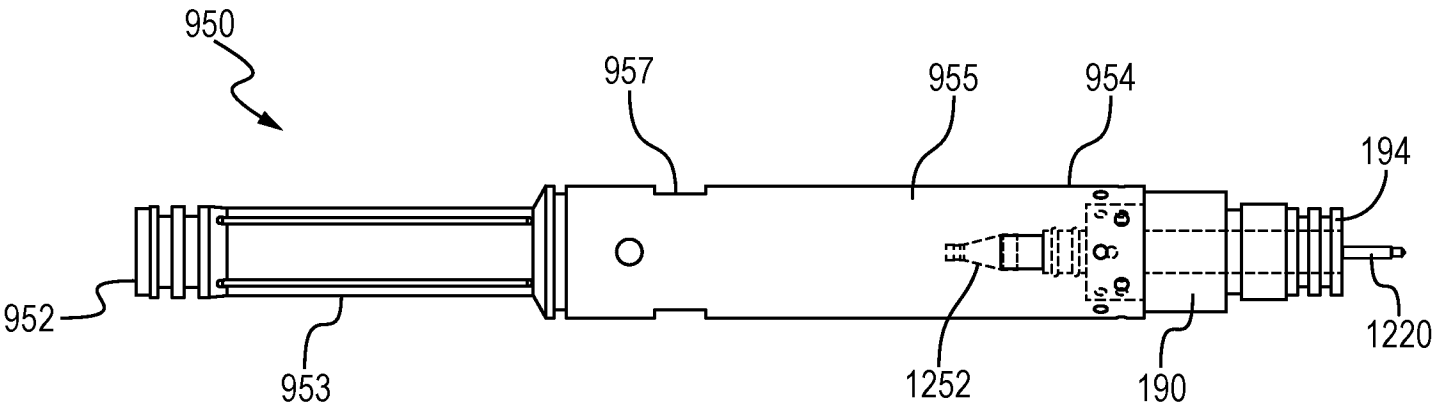
FIG. 12J is still another side view of the electrical connection sub of FIG. 12A. Here, a first, or upstream, end of the electrical connection sub has been positioned inside of a second, or downstream, end of the plunger of FIG. 11A.

FIG. 12J is still another side view of the electrical connection sub 190 of FIG. 12A. Here, the first, or upstream, end 192 of the electrical connection sub 190 has been positioned inside of the second, or downstream, end 954 of the plunger 950. The second end 954 of the plunger 950 shoulders out on surface 197. It is noted that the upstream end 1252 of the signal line connector 1250 is now visible, in phantom, within the plunger 950.

Figure 12K:
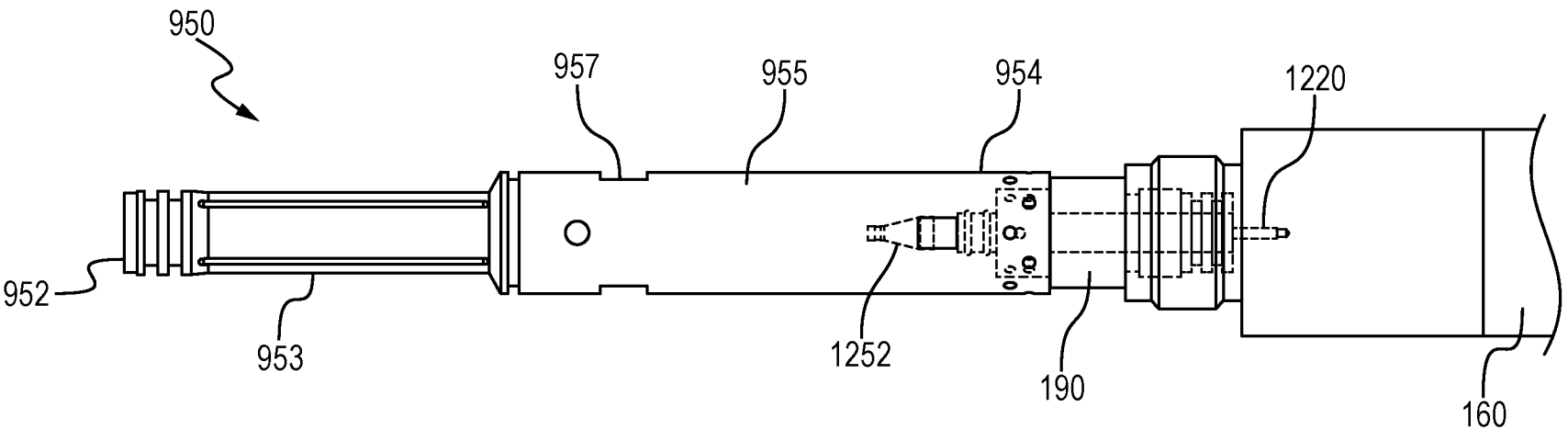
FIG. 12K is yet another side view of the electrical connection sub of FIG. 12A. Here, the first, or upstream, end of the electrical connection sub has again been positioned inside of the second, or downstream, end of the plunger. At the same time, the second, or downstream, end of the electrical connection sub is extending into a downhole tool.

FIG. 12K is yet another side view of the electrical connection sub 190 of FIG. 12A. The upstream end 192 of the electrical connection sub 190 has again been positioned inside of the downstream end 954 of the plunger 950. At the same time, the downstream end 194 of the electrical connection sub 190 is seen extending into the connector sub 160. The electrical connection sub 190 is designed to attach, for example by threaded connection, onto the connector sub 160 or other downhole tool.

The conductive pin 1220 is shown, in phantom, within the connector sub 160. The pin 1220 is then used to transmit electrical signals up and down the wellbore through the wireline cutting tool 900. Such signals may include:

- detonation signals sent downhole to perforating guns;
- set signals sent to the setting tool for the plug;
- signals sent from the formation logging tool back up to the surface;
- signals sent from the downhole sensor, such as a microphone or temperature sensor, back up to the surface; and
- signals sent from the casing collar locator or a cement bond log.

Figure 13A:
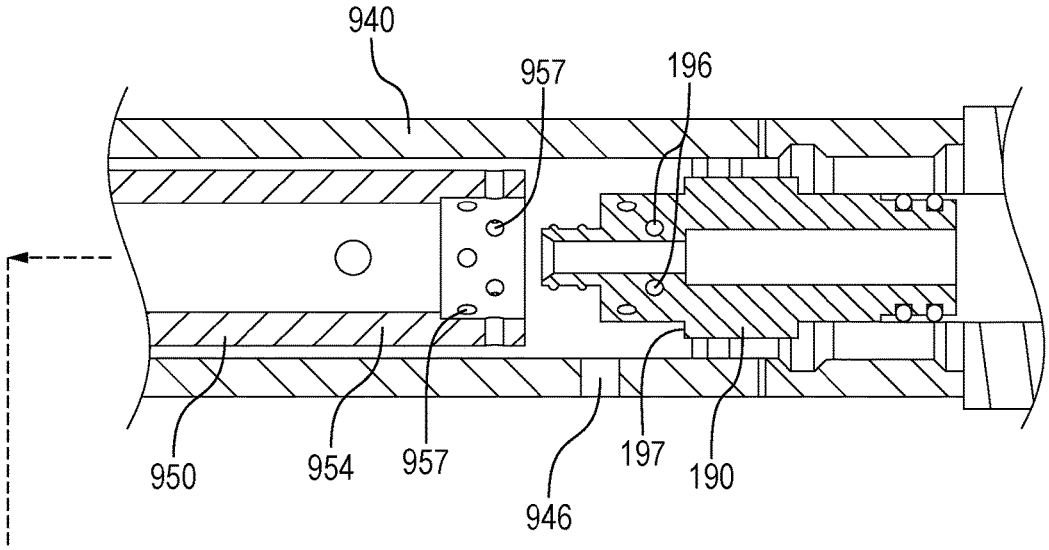
FIGS. 13A and 13B together present an enlarged, cross-sectional view of the wireline cutting tool of FIG. 9B. Here, the plunger has separated from the electrical connection sub and has advanced up the wireline cutting tool. This is in response to the first shear load. The plunger has engaged the knives in the knife housing.
Figure 13B:
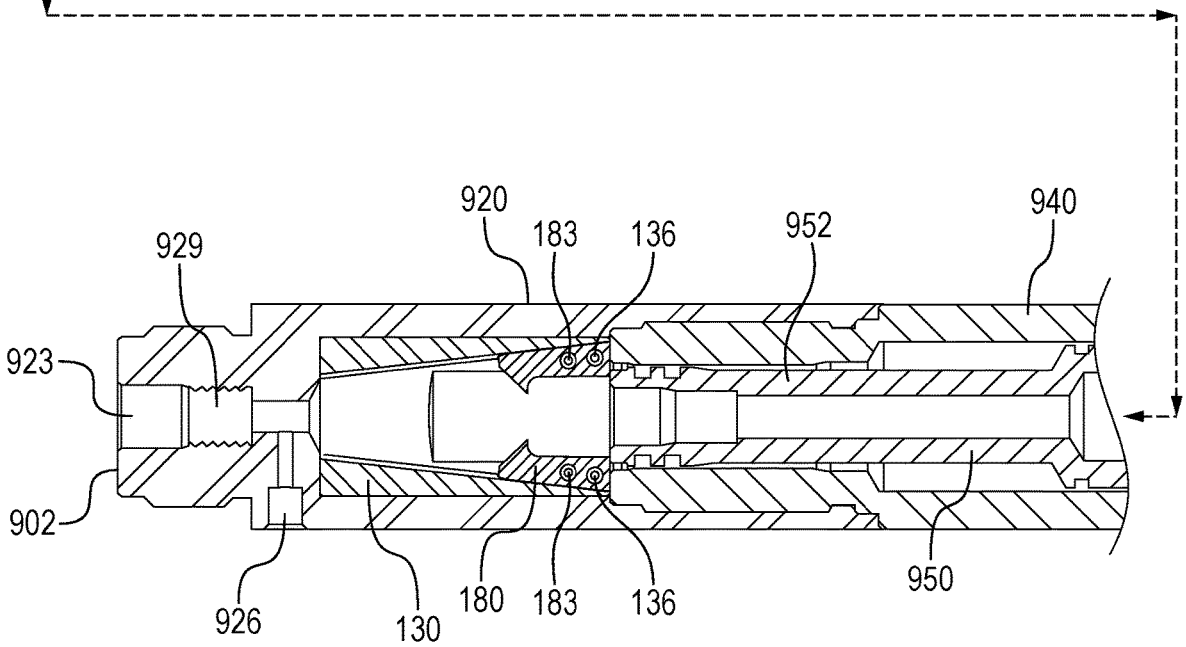

FIGS. 13A and 13B together present an enlarged, cross-sectional view of the wireline cutting tool 900 of FIG. 9B. Here, the plunger 950 has separated from the electrical connection sub 190 and has advanced up the bore 941 of the lower sub 940. An upper end 952 of the plunger 950 has engaged the knives 180 in the knife housing 130. (Note that the pin 1220 and signal line connector 1250 have been removed for illustrative purposes.)

Figure 14A:
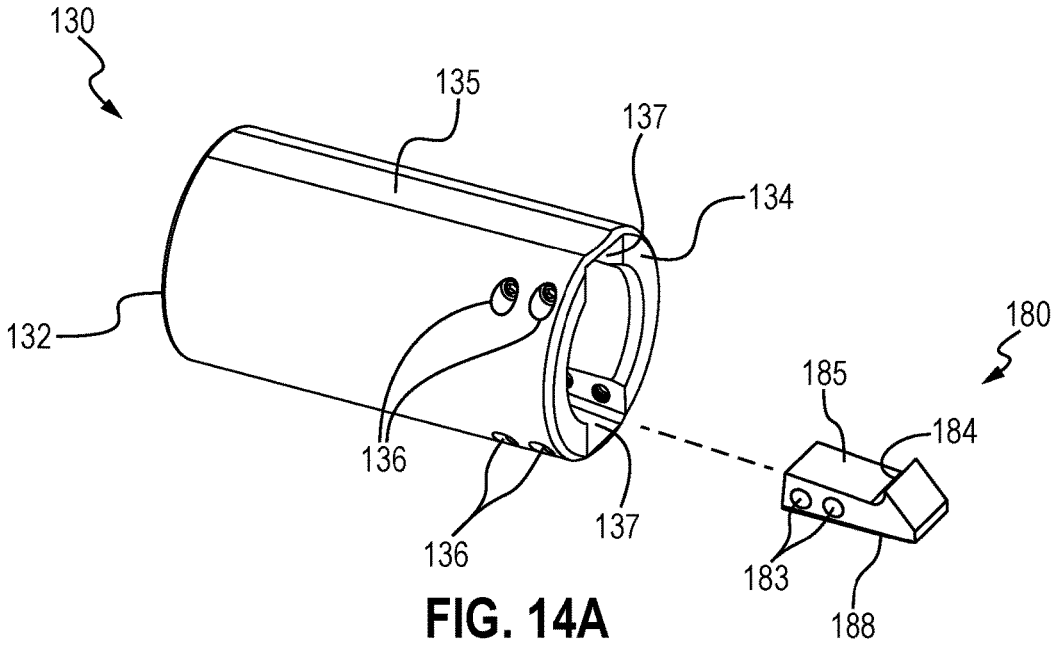
FIG. 14A is another perspective view of the knife housing of FIG. 3A. In this view, the knives have been removed for illustrative purposes. A single knife is shown in exploded-apart relation.

FIG. 14A is another perspective view of the knife housing 130 of FIG. 3A. In this view, the knives 180 have been removed. Channels 137 are revealed, which would otherwise hold the knives 180. A single knife 180 is shown in exploded-apart relation to the knife housing 130. The knife 180 has been removed from channel 137 for illustrative purposes.

It can be seen that the knife 180 includes an inner surface 185. The inner surface 185 faces the inner bore 131. The knife 180 also has an outer surface 188 which abuts an inner diameter of the knife housing 130. Openings 183 are provided along the knife 180. The openings 183 are dimensioned to align with through-openings 136 in the tubular body 135 of the knife housing 130 and are configured to slidingly receive the pins 186.

Figure 14B:
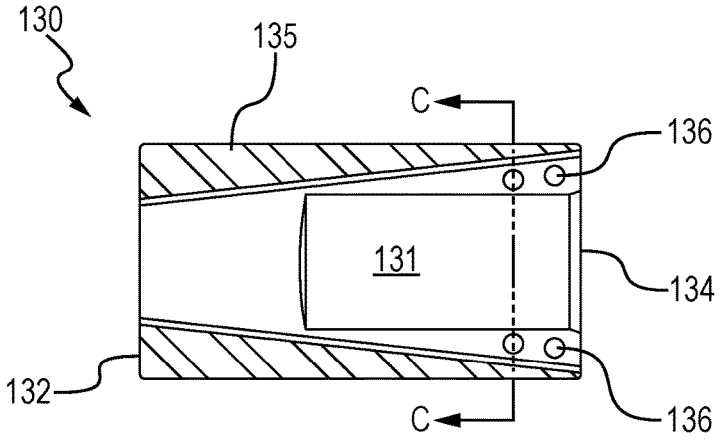
FIG. 14B is a cross-sectional view of the knife housing of FIG. 14A. Again, the knives have been removed.

FIG. 14B is a cross-sectional view of the knife housing 130 of FIG. 14A. This is the same view as is shown in FIG. 3B, except the knives 180 have been removed. The inner bore 131 is visible. Note again that the inner bore 131 tapers inwardly moving from the downstream end 134 to the upstream end 132.

Figure 14C:
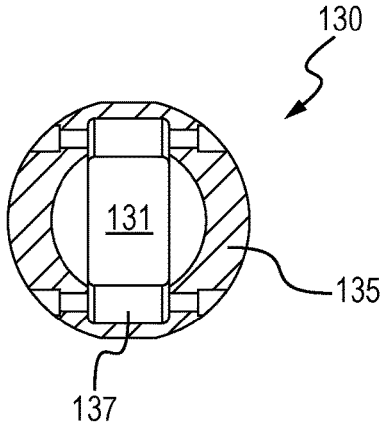
FIG. 14C is another cross-sectional view of the knife housing of FIG. 14A. Here, the cut is taken across Line C-C of FIG. 14B.

FIG. 14C is another cross-sectional view of the knife housing 130 of FIG. 14A. Here, the cut is taken across Line C-C of FIG. 14B. This is the same view as is shown in FIG. 3C, except the knives 180 have again been removed.

FIG. 9C is yet another cross-sectional view of the wireline cutting tool 900 of FIG. 9A. Here, the second shear load has been applied to the wireline cutting tool 900, resulting in a sliding of the knives 180 up the knife housing 130. This, in turn, causes the knife blades 184 (shown in FIGS. 14A and 15B) of the knives 180 to pinch the electric wireline 105 (not shown in this view) and ultimately sever the electric wireline 105.

Figure 15A:
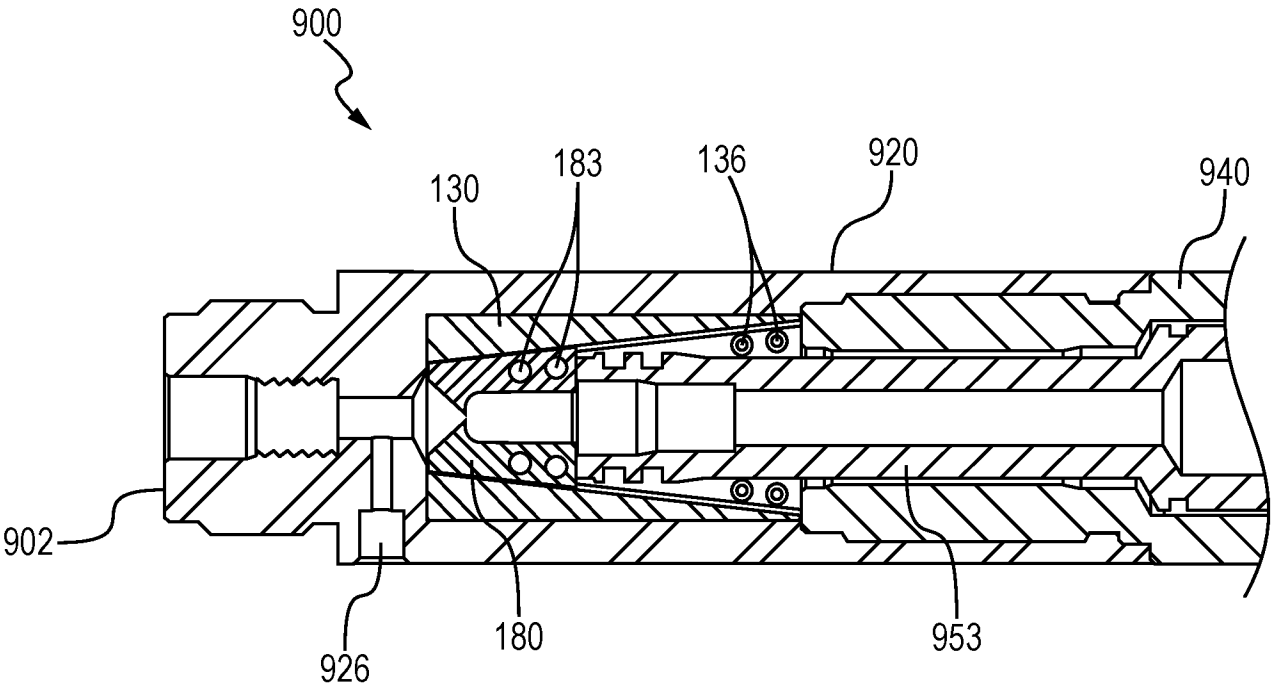
FIG. 15A is an enlarged, cross-sectional view of a portion of the wireline cutting tool of FIG. 9C. Here, the plunger has sheared pins holding the knives in place along the knife housing. This is in response to a second shear load. The knives have moved up the bore of the knife housing.

FIG. 15A is an enlarged perspective view of a portion of the wireline cutting tool 900 of FIG. 9C. Here, the plunger 950 has acted against the knife housing 130 and has sheared pins 186 holding the knives 180 in place along the knife housing 130. This, again, is in response to the second shear load. The second shear load is greater than the first shear load.

Figure 15B:
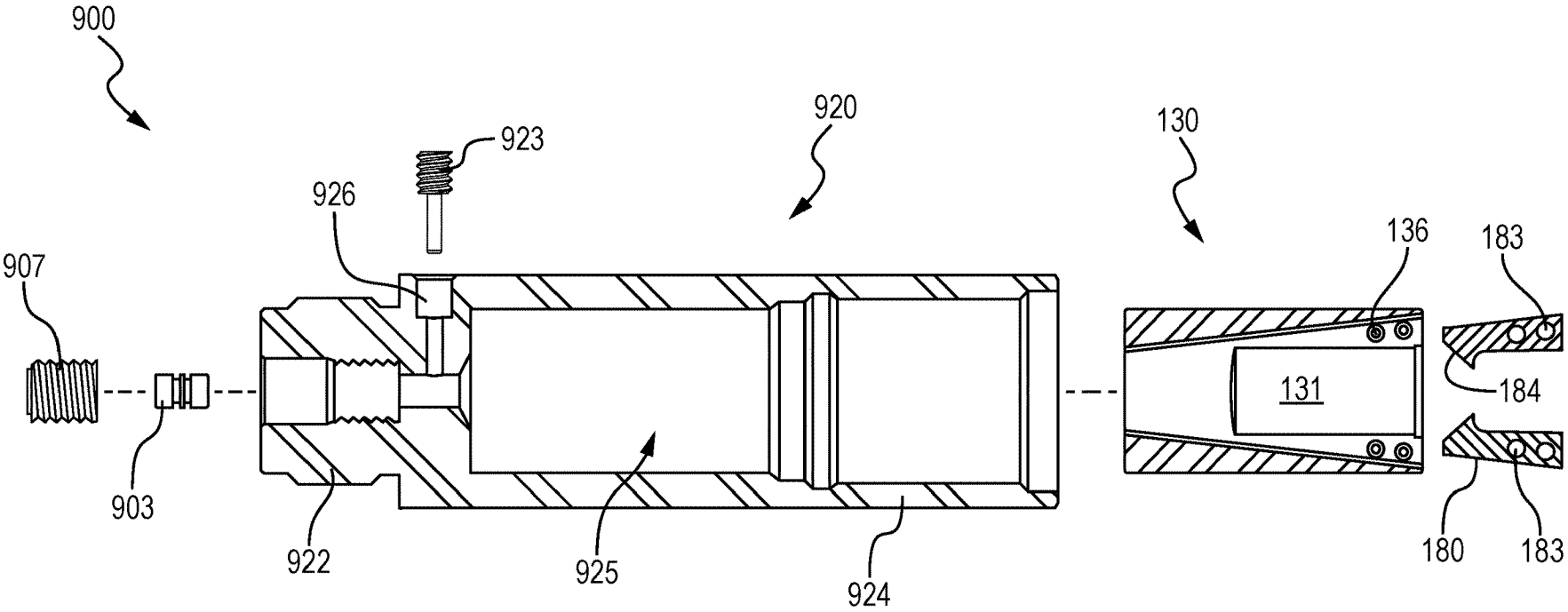
FIG. 15B is a side view of the portion of the wireline cutting tool of FIG. 15A. The knife housing and knives are shown in exploded-apart relation from the upper sub.

FIG. 15B is a side view of the portion of the wireline cutting tool 900 of FIG. 15A. In this view, a bushing 903 and a corresponding hex nut 907 are shown exploded apart from the upper sub 920, oriented in an upstream direction. The hex nut 907 is used to screw the bushing 903 down onto the first end 922 of the upper sub 920, which holds the bushing 903 in place. At the same time, the knife housing 130 and knives 180 are shown in exploded-apart relation from the upper sub 920 in a downstream direction.

It can be seen that novel wireline cutting tools 100 and 900 have been presented. Using the wireline cutting tools 100 or 900, the present disclosure also provides for a method of cutting an electrical wireline within a wellbore.

Figure 16A:
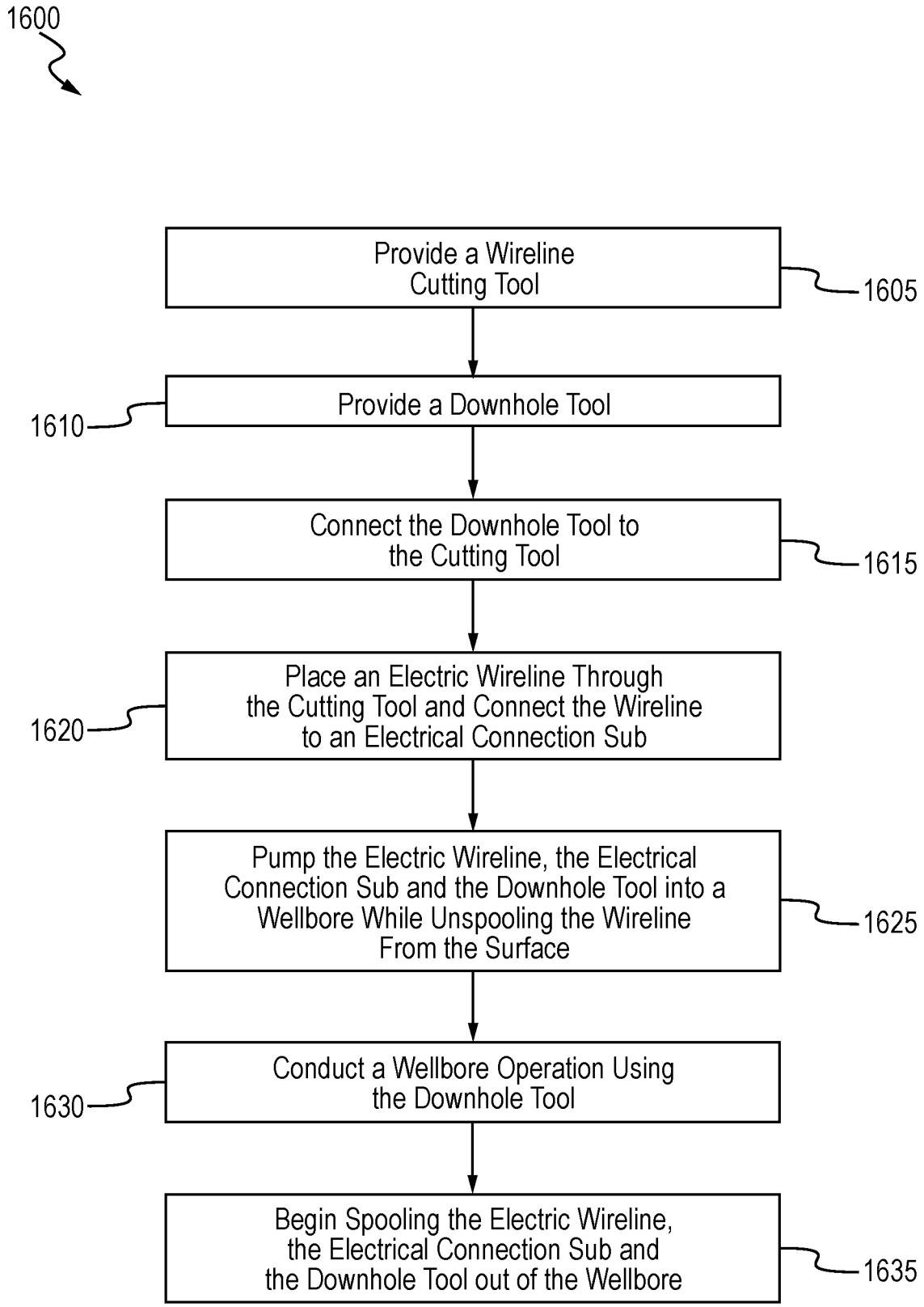
FIGS. 16A and 16B together present a single flow chart showing steps for a method of cutting an electrical wireline within a wellbore in one embodiment.
Figure 16B:
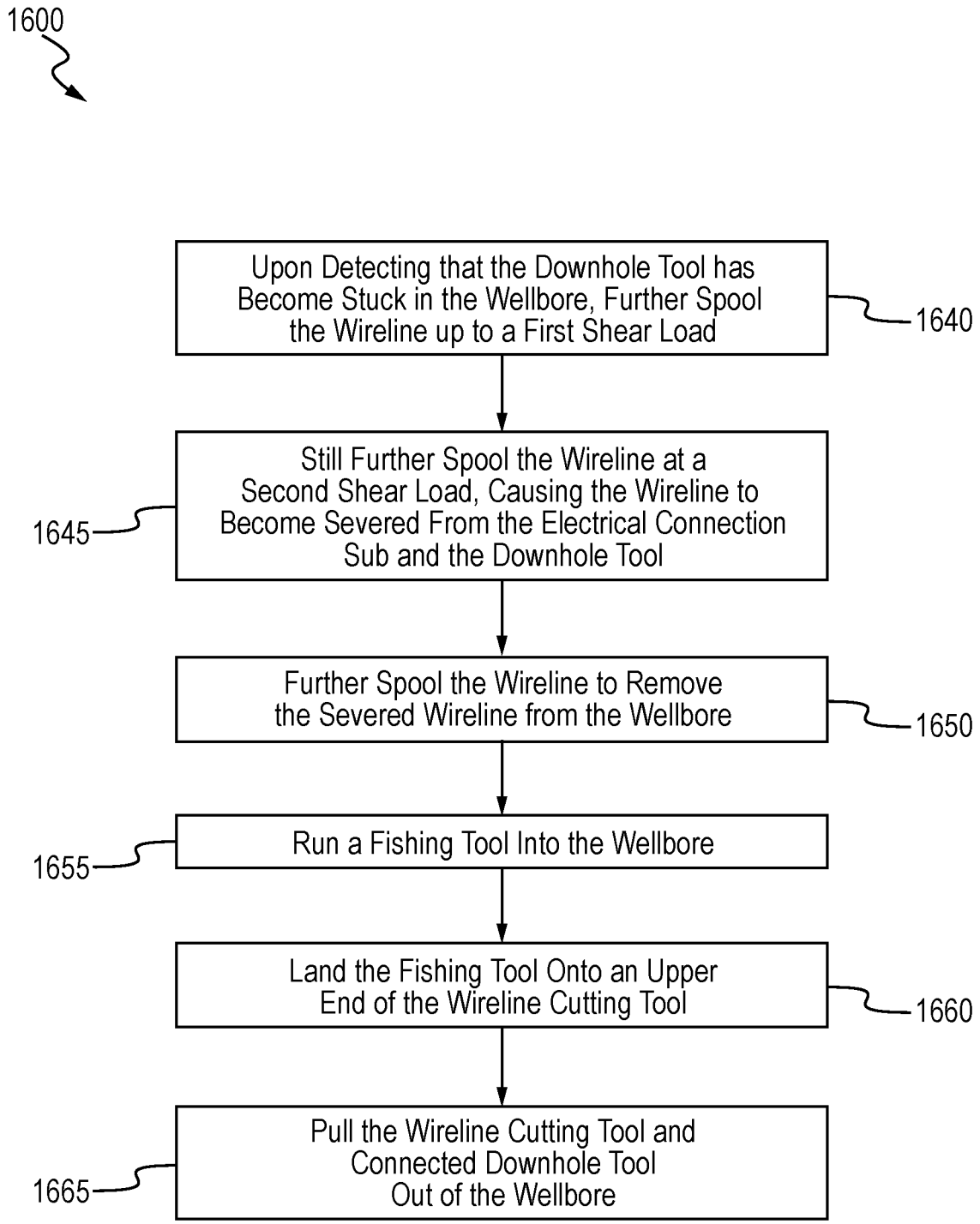

A method of cutting an electrical wireline within a wellbore is also provided herein. FIGS. 16A and 16B together present a single flow chart showing steps for a method 1600 of cutting the wireline in one embodiment.

The method 1600 first includes providing the wireline cutting tool. This is shown in Box 1605. The wireline cutting tool may be configured in accordance with the tool disclosed above in connection with FIGS. 1A and 1B, or FIGS. 9A, 9B, and 9C.

In essence, the wireline cutting tool will comprise:

an upper tubular sub;

a knife housing residing within the upper tubular sub;

at least one knife residing within the knife housing;

a lower tubular sub; and a plunger residing within the lower tubular sub.

The method 1600 also includes providing a downhole tool. This is provided in Box 1610. The downhole tool may be, for example, a casing collar locator (optionally including a CCL connector sub) or a perforating gun assembly.

The method 1600 further comprises connecting the downhole tool to the cutting tool. This is shown in box 1615. Connecting the downhole tool to the cutting tool preferably is done by connecting the downhole tool to a lower end of an electrical connection sub, such as by means of a threaded connection. Alternatively, the downhole tool may be threadedly connected to a downstream end of the lower sub. At the same time, the plunger is releasably connected to an upper end of the electrical connection sub.

The method 1600 next includes running an electric wireline through a bore of each of the knife housing and the plunger. This is seen in box 1620. Preferably, the step of Box 1620 involves stripping away, or splicing, an outer insulating coating of the wireline, exposing the wires, at least through the bore of the plunger. All of the armors of the wireline cable are tied into the plunger, providing a full strength of the wireline to the plunger. This enables the shear pins 959, which reside in through-openings 958 and extend into the holes 196 of the electrical connection sub, to serve as the point of weakness. Thus, when the wireline is pulled at a first shear load, the plunger 950 is separated from the electrical connection sub.

The method 1600 also comprises pumping the electric wireline, the electrical connection assembly, and the downhole tool into the wellbore. This is indicated at Box 1625. Typically, the wellbore will be completed to have a horizontal section, which may often exceed a length of one mile and sometimes two or even three miles. This is down by forming a "dogleg" using directional drilling technology as is known in the art. While the tools are moving downhole and across the dogleg, the wireline is unspooled from the surface.

The method 1600 further includes conducting a wellbore operation using the downhole tool. This is seen in Box 1630. The wellbore operation may be, for example, a perforating operation, a plug setting operation, a well-logging operation, a formation fracturing operation, or combinations thereof.

The method 1600 also comprises spooling the electric line back up towards the surface. This is provided at Box 1635. As the electric line is spooled, the wireline cutting tool, the electrical connection assembly, and the downhole tool are brought to the surface together. As the electric line is spooled, it is not uncommon, or at least it is not rare, for a portion of the tool string to become stuck.

As shown in Box 1640, upon detecting that the downhole tool has become irretrievably stuck in the wellbore, an operator will further spool the wireline. The wireline operator will spool the line until the first shear load is reached. This will cause the plunger to separate from the electrical connection sub and travel up the bore of the lower tubular sub. Stated another way, shear pins 959 will together shear upon the first shear load. Immediately thereafter, the plunger will pass through the grease pocket of the lower sub, elongating a conductor cable. This allows a winch operator time to shut down before the second set of pins, that is, the pins in the knife housing, become sheared under the second shear load and the cable is cut.

The time delay afforded by the grease pocket can vary, depending on fluid viscosity, temperature, and the amount of tension applied by the winch operator. The grease prevents the plunger from slamming into the knives, preserving the integrity of the wireline cutting tool for a next job. Furthermore, the grease may provide a lubrication to the wireline to assist in smooth operation and to reduce the potential for fraying of the wireline while within the wellbore.

It is noted that in a preferred embodiment, a lower end of the wireline is in electrical communication with a pin associated with the electrical connection sub. This may be done, for example, through soldering, splicing, a banana clip, or other electrical connector means. When the shear pins 959 in the electrical connection sub 190 are sheared in the step of Box 1640, the connection between the wireline 105 and the pin 1220 is also easily broken. This, of course, results in a loss of electrical communication between the surface and the downhole tool(s).

The method 1600 also includes still further spooling the wireline up to the second shear load. This is seen in Box 1645. The second shear load will cause pins 186, which hold the knives 180 in place along the knife housing 130, to shear. Because of the angled inner diameter within the knife housing 130, the knives 180 will travel up the inner bore 131 of the knife housing 130 and squeeze together. The knife blades 184 will pinch the electric wireline 105 to the point of cutting.

The shear pins 959 and the grease pocket/time delay work together with the cutting action to create a more predictable tool. In this way, the wireline 105 may be severed in a clean and efficient manner and allow for a removal of the wireline 105, leaving the downhole tool in place within the wellbore. This is provided in Box 1650 and shown in FIG. 15. Per the step of Box 1650, the severed cable is pulled freely out of the wellbore.

Note that in connection with the method 1600, the second shear load is greater than the first shear load.

In one embodiment, the method 1600 further comprises running a fishing tool into the wellbore. This is indicated at Box 1655. The fishing tool is sometimes referred to as an overshot.

The method 1600 may also include landing the fishing tool onto an upper end 902 of the wireline cutting tool 900. This is presented in Box 1660. The method 1600 will then include pulling the wireline cutting tool 900 and connected downhole tool out of the wellbore. This is shown at Box 1665.

Further, variations of the wireline cutting tool, the electrical connection assembly, and the method of severing an electrical wireline may fall within the spirit of the claims below. It will be appreciated that the inventions are susceptible to modification, variation and change without departing from the spirit thereof.

What is claimed is:

1. A wireline cutting tool, comprising:

an elongated tubular body having an upper end, a lower end, and a bore extending from the upper end to the lower end;

a knife housing residing within the bore of the tubular body proximate the upper end, the knife housing having a first end, a second end opposite the first end, and a bore extending from the second end and up through the first end, wherein the bore of the knife housing tapers inwardly moving in a direction from the second end of the knife housing to the first end of the knife housing;

a plunger residing within the bore of the tubular body below the knife housing, the plunger also having a first end and a second end opposite the first end, wherein the plunger is held in place by a first shear member at a first longitudinal location and configured to slide up the bore of tubular body in response to shearing the first shear member at a first shear load applied by a wellbore wireline; and at least one knife residing along the bore of the knife housing, with the at least one knife being held in place by a second shear member at a second longitudinal location above the first longitudinal location and configured to slide up the bore of the knife housing from the second end of the knife housing towards the first end of the knife housing in response to shearing the second shear member at a second shear load applied by the wellbore wireline; and an electrical connection sub residing proximate the lower end of the elongated tubular body, the electrical connection sub holding a conductive pin configured to be in electrical communication with the wellbore wireline and forming a pin connector assembly;

wherein:

the sliding up of the plunger causes the first end of the plunger to engage a lower end of the at least one knife; and the sliding up of the at least one knife causes the wellbore wireline to be pinched and severed.

2. The wireline cutting tool of claim 1, wherein:

the elongated tubular body comprises:

an upper sub having a first end, a second end opposite the first end, and a bore extending from the second end and up through the first end; and a lower sub having a first end, a second end opposite the first end, and a bore extending from the second end and through the first end, wherein the first end of the lower sub is connected to the second end of the upper sub;

and wherein:

the knife housing resides within the bore of the upper sub, and the plunger resides primarily within the bore of the lower sub.

3. The wireline cutting tool of claim 2, wherein:

the first end of the upper sub comprises male threads, while the second end of the upper sub comprises female threads; and the first end of the lower sub comprises male threads.

4. The wireline cutting tool of claim 2, wherein:

the bore of the knife housing and the bore of the plunger are configured to receive the wellbore wireline;

the first shear load is applied to the wellbore wireline by being spooled from a surface, wherein tension is applied to the wellbore wireline that pulls the plunger upward; and the second shear load is applied by the plunger acting against the at least one knife, also in response to the wellbore wireline being spooled from the surface, such that the plunger pushes the at least one knife upward;

and wherein the second shear load is greater than the first shear load.

5. The wireline cutting tool of claim 4, wherein:

an upstream portion of the bore of the lower sub holds a viscous fluid; and the viscous fluid impedes the travel of the plunger as it slides towards the knife housing after the first shear load has been applied to the wellbore wireline.

6. The wireline cutting tool of claim 4, further comprising:

wherein the first shear member comprises at least one shear pin holding the plunger in place along the electrical connection sub;

and wherein:

the wellbore wireline is an electric wireline;

the electrical connection sub defines a tubular body, with the tubular body having a shoulder along an outer diameter that abuts the second end of the plunger, and a bore;

a lower end of the lower sub is operatively connected to a downhole tool; and the conductive pin resides within the bore of the electrical connection sub, and is fabricated from an electrically conductive material to transmit signals from the electric wireline to the downhole tool.

7. The wireline cutting tool of claim 6, wherein the downhole tool is a casing collar locator sub, a well-logging tool, or a perforating gun assembly.

8. The wireline cutting tool of claim 6, wherein:

the electrical wireline comprises armors, with the armors being mechanically connected to the plunger; and the at least one shear pin holding the plunger in place comprises at least two shear pins, with the at least two shear pins holding the plunger in place being designed to shear at the first shear load, thereby disconnecting the plunger from the electrical connection sub.

9. The wireline cutting tool of claim 6, further comprising:

wherein the second shear member comprises at least one shear pin holding the at least one knife in place along the bore of the knife housing, wherein the at least one shear pin holding the knife in place is designed to shear at the second shear load.

10. The wireline cutting tool of claim 9, wherein:

the at least one knife comprises a pair of knives disposed on opposing sides of the bore of the knife housing; and the at least one shear pin holding the at least one knife in place comprises at least one shear pin holding each of the two knives in place, respectively.

11. The wireline cutting tool of claim 10, wherein the first end of the upper sub comprises a tubular neck having male threads along an outer diameter of the tubular neck, with the tubular neck serving as a fishing neck.

12. The wireline cutting tool of claim 11, wherein:

the first end of the upper sub further comprises female threads along an inner diameter of the tubular neck;

the inner diameter of the tubular neck is aligned with the bore of the upper sub; and the wireline cutting tool further comprises a bushing residing within the inner diameter of the tubular neck, frictionally receiving the wellbore wireline, and a nut threaded into the inner diameter of the tubular neck holding the bushing in place within the tubular neck.

13. The wireline cutting tool of claim 10, wherein:

the pin connector assembly further comprises a pin connector having a non-conductive housing, with the pin connector residing within the electrical connection sub, and the conductive pin residing within a bore of the non-conductive housing; and a downstream end of the conductive pin is configured to be placed in electrical communication with a signal line associated with the downhole tool.

14. The wireline cutting tool of claim 13, wherein:

the pin connector assembly further comprises a signal line connector having an upstream end and a downstream end;

the signal line connector is in electrical communication with the wellbore wireline at the upstream end, and is in electrical communication with the conductive pin at the downstream end.

15. The wireline cutting tool of claim 14, wherein:

the non-conductive housing comprises a bore;

the conductive pin resides within the bore of the non-conductive housing;

the bore of the non-conductive housing comprises a threaded portion at an upstream end; and the signal line connection is connected to the bore of the non-conductive housing by means of the threaded portion.

16. A method of cutting a wireline within a wellbore, comprising:

providing a wireline cutting tool, the wireline cutting tool comprising:

an elongated tubular body;

a knife housing residing within the tubular body proximate an upper end of the tubular body;

at least one knife residing within the knife housing;

a plunger residing within the tubular body proximate a lower end of the tubular body; and an electrical connection assembly, with the electrical connection assembly comprising an electrical connection sub, and a conductive pin residing within a bore of the electrical connection sub;

releasably connecting the plunger to the electrical connection sub;

providing a downhole tool;

connecting the downhole tool to the lower end of the tubular body;

running an electric wireline through a bore of each of the knife housing and the plunger;

electrically connecting a lower end of the electric wireline to the conductive pin of the electrical connection assembly;

pulling the wireline cutting tool, the electrical connection assembly, and the downhole tool out of a wellbore together by spooling the electric wireline from a surface;

upon detecting that the downhole tool has become stuck in the wellbore, further spooling the electric wireline at a first shear load, causing the plunger to separate from the electrical connection assembly and travel up the bore of the tubular body such that the plunger shoulders out against a lower end of the at least one knife; and still further spooling the wireline at a second shear load, causing the at least one knife to travel up the bore of the knife housing and sever the electric wireline within the wellbore, leaving the downhole tool in place within the wellbore;

and wherein the second shear load is greater than the first shear load.

17. The method of claim 16, further comprising:

still further spooling the wireline in order to remove the electric wireline from the wellbore.

18. The method of claim 17, further comprising:

running a fishing tool into the wellbore;

landing the fishing tool onto an upper end of the tubular body; and pulling the wireline cutting tool and connected downhole tool out of the wellbore.

19. The method of claim 16, wherein:

the elongated tubular body comprises:

an upper sub having a first end comprising male threads, a second end opposite the first end, and a bore extending from the second end and through the first end; and a lower sub having a first end, a second end opposite the first end, and a bore extending from the second end and through the first end, wherein the first end of the lower sub is connected to the second end of the upper sub;

and wherein:

the knife housing resides within the bore of the upper sub, and has a first end and a second end opposite the first end, and wherein the bore extends from the second end and through the first end, and with the bore of the knife housing tapering inwardly in a direction from the second end of the upper sub to the first end; and the plunger resides at least partially within the bore of the lower sub, and also has a first end and a second end opposite the first end.

20. The method of claim 19, wherein the wireline cutting tool further comprises:

at least one shear pin holding the plunger in place along the electrical connection assembly up to the first shear load; and at least one shear pin holding the at least one knife in place along the bore of the knife housing up to the second shear load.

21. The method of claim 20, wherein the downhole tool is a casing collar locator sub or a perforating gun assembly.

22. The method of claim 20, wherein:

the at least one shear pin holding the plunger in place comprises at least two shear pins, with the at least two shear pins holding the plunger in place being fabricated to shear at the first shear load, thereby disconnecting the plunger from the electrical connection sub;

the at least one knife comprises a pair of knives disposed on opposing sides of the bore of the knife housing; and the at least one shear pin holding the at least one knife in place comprises at least one shear pin holding each of the two knives in place, respectively, with the shear pins holding the two knives in place being fabricated to shear at the second shear load.

23. The method of claim 19, wherein the electrical connection assembly comprises:

a pin connector residing within the bore of the electrical connection sub, with the pin connector holding the conductive pin, and wherein a downstream end of the conductive pin extends out of the electrical connection sub; and a non-conductive housing extending along the bore of the electrical connection sub and separating the conductive pin from the electrical connection sub.

24. The method of claim 23, wherein:

the bore of the pin connector comprises a threaded portion;

the electrical connection assembly further comprises a signal line connector threadedly connected to the threaded portion of the bore of the pin connector, and places the electric wireline in electrical communication with the conductive pin.

25. The method of claim 24, wherein the electrical connection assembly further comprises a spring residing within the bore of the non-conductive housing, wherein the spring is wound around the conductive pin, with the spring residing in compression and biasing the conductive pin out of the bore of the electrical connection sub at a downstream end of the electrical connection sub.

* * * * *